US008801247B2

(12) United States Patent
Sugie et al.

(10) Patent No.: US 8,801,247 B2
(45) Date of Patent: Aug. 12, 2014

(54) VEHICLE HEADLAMP

(75) Inventors: Yoshihiro Sugie, Isehara (JP); Yasuhiro Okubo, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 13/081,940

(22) Filed: Apr. 7, 2011

(65) Prior Publication Data

US 2011/0249461 A1 Oct. 13, 2011

(30) Foreign Application Priority Data

Apr. 12, 2010 (JP) ..... 2010-091814

(51) Int. Cl.
*F21V 33/00* (2006.01)
*F21Y 101/02* (2006.01)
*F21S 8/10* (2006.01)

(52) U.S. Cl.
CPC ..... *F21S 48/1159* (2013.01); *F21Y 2101/02* (2013.01); *F21S 48/125* (2013.01); *F21S 48/145* (2013.01); *F21S 48/155* (2013.01); *F21S 48/1317* (2013.01); *F21S 48/1109* (2013.01); *F21S 48/1163* (2013.01)
USPC ..... 362/516

(58) Field of Classification Search
USPC ..... 362/516–519
See application file for complete search history.

(56) References Cited

U.S. PATENT DOCUMENTS 6,637,921 B2 10/2003 Coushaine
6,846,101 B2 1/2005 Coushaine
7,712,935 B2 5/2010 Tsukamoto et al.
7,762,700 B2 7/2010 Luo et al.
7,794,128 B2 9/2010 Fujiwara et al.
7,812,363 B2 10/2010 Higashi
2003/0063474 A1 4/2003 Coushaine
2004/0057252 A1 3/2004 Coushaine
2005/0068787 A1* 3/2005 Ishida ..... 362/538
2008/0225540 A1 9/2008 Tsukamoto et al.
2008/0225544 A1 9/2008 Fujiwara et al.
2008/0291688 A1 11/2008 Higashi
2009/0296416 A1 12/2009 Luo et al.
2010/0202152 A1* 8/2010 Nakada ..... 362/517

FOREIGN PATENT DOCUMENTS

JP 64-000601 A 1/1999
JP 2003-178612 A 6/2003
JP 2007-149382 A 6/2007
JP 2008-226707 A 9/2008
JP 2008-226788 A 9/2008
JP 2008-294181 A 12/2008
JP 2009-289751 A 12/2009
JP 2010-040322 A 2/2010

* cited by examiner

*Primary Examiner* — Anh Mai
*Assistant Examiner* — Brenitra M Lee
(74) *Attorney, Agent, or Firm* — Foley & Lardner LLP

(57) ABSTRACT

A vehicle headlamp according to the present invention is provided with: a semiconductor-type light source 5U; a reflector 3; a holder 6; a mount member 70U; and a light shading member 12U which has first additional reflection surfaces 15U, 15U as optical members. The mount member 70U and the light shading member 12U that has the first additional reflection surfaces 15U, 15U form an integrated structure. As a result, the vehicle headlamp according to the present invention is capable of mutually mounting, with high precision, a semiconductor-type light source 5U and the light shading member 12U that has the first additional reflection surfaces 15U, 15U as the optical members.

10 Claims, 32 Drawing Sheets

VEHICLE HEADLAMP

CROSS REFERENCE TO RELATED APPLICATIONS

This application claims priority of Japanese Patent Application No. 2010-091814 filed on Apr. 12, 2010. The contents of this application are incorporated herein by reference in their entirety.

BACKGROUND OF THE INVENTION

1. Field of the Invention

The present invention relates to a vehicle headlamp using a semiconductor-type light source as a light source.

2. Description of the Related Art

A vehicle headlamp of such type is conventionally known (for example, Japanese Patent Application Laid-open No. 2008-226707). Hereinafter, a conventional vehicle headlamp will be described. The conventional vehicle headlamp is provided with: a semiconductor light source element; a reflector for reflecting light from the semiconductor light emitting element forward of a lighting device; and optical parts which are provided at the forward side of the lighting device of the semiconductor light emitting element and are securely tightened with the reflector by means of mount screws. Hereinafter, functions of the conventional headlamp will be described. A part of the light from the semiconductor light emitting element is reflected by means of the reflector and then is reflected forward of the lighting device with a predetermined light distribution pattern. In addition, the remaining one of the light from the semiconductor light emitting element is emitted forward of the lighting device with the emitting direction being adjusted and/or a part of the emitted light is shaded.

In such a vehicle headlamp, in order to emit and shade the remaining part of the light from the semiconductor light emitting element, it is important to mutually mount the semiconductor light emitting elements and optical parts with high precision.

The problem to be solved by the present invention is that, in the vehicle headlamp of such type, in order to emit and shade the remaining part of the light from the semiconductor light emitting element, it is important to mutually mount the semiconductor light emitting elements and optical parts with high precision.

SUMMARY OF THE INVENTION

In the present invention of the claim 1: A vehicle headlamp employing a semiconductor-type light source as a light source, said headlamp comprising:

- the semiconductor-type light source having a light emitting chip;
- a reflector having a reflection surface for reflecting light from the light emitting chip and then emitting the reflected light forward of a vehicle as a predetermined light distribution pattern;
- a holding member by which the reflector is held;
- a mount member for mounting the semiconductor-type light source on the holding member; and
- an optical member for optically processing light directly radiated from the light emitting chip forward of the vehicle, wherein
- the mount member and the optical member forms an integrated structure.

In the present invention of the claim 2: The vehicle headlamp according to claim 1, wherein

- the optical member is made of at least a free curved face in which a first reference focal point is positioned at or near the light emitting chip and a second reference focal point is positioned at a location displaced from the light emitting chip,
- the optical member is comprised of an additional reflection surface for converging and reflecting the light directly radiated from the light emitting chip forward of the vehicle on the second reference focal point so as to be emitted as a predetermined additional light distribution pattern forward of the vehicle on an additional reflection surface provided at the reflector.

In the present invention of the claim 3: The vehicle headlamp according to claim 1, wherein

- the optical member is comprised of a free curved lens in which a lens focal point is positioned at or near the light emitting chip and the light directly radiated from the light emitting chip forward of the vehicle is emitted forward of the vehicle as a predetermined additional light distribution pattern.

In the present invention of the claim 4: The vehicle headlamp according to claim 1, wherein

- the optical member is comprised of a shade which is adapted to shade the light directly radiated from the light emitting chip forward of the vehicle.

In the vehicle headlamp according to the present invention (the invention according to claim 1), a mount member and an optical member form an integrated structure, so that a semiconductor-type light source is mounted on a holding member by means of the mount member, whereby the semiconductor-type light source and the optical member are mutually mounted with high precision via the mount member. As a result, in the vehicle headlamp of the present invention (the invention according to claim 1), a relative position between the semiconductor-type light source and the optical member becomes high in precision, so that light which is directly radiated from a light emitting chip of the semiconductor-type light source forward of a vehicle can be optically processed with higher precision by means of the optical member.

Moreover, in the vehicle headlamp of the present invention (the invention according to claim 1), the mount member and the optical member form an integrated structure, so that the number of parts can be reduced, and as a result, a mounting operation is simplified and manufacturing cost is reduced.

In addition, in the vehicle headlamp of the present invention (the invention according to claim 2), by means for solving the abovementioned problem, the light that is directly radiated from the light emitting chip of the semiconductor-type light source forward of the vehicle is reflected on an additional reflection surface of the optical member that is integrally structured with the mount member to the additional reflection surface side and then the reflected light can be emitted forward of the vehicle as a predetermined light distribution pattern on the additional reflection surface of a reflector. In this manner, the vehicle headlamp of the present invention (the invention according to claim 2) is capable of effectively utilizing the light that is directly radiated from the light emitting chip of the semiconductor-type light source forward of the vehicle, i.e., ordinarily invalid light.

Moreover, in the vehicle headlamp of the present invention (the invention according to claim 2), the optical member of the additional reflection surface is integrally structured with the mount member, and is mounted on the holding member via the mount member together with the semiconductor-type light source, whereas the reflector at which the additional reflection surface is provided is held by means of the holding member, so that an additional light distribution pattern can be controlled to be optically distributed with high precision by means of the additional reflection surface of the optical member and the additional reflection surface of the reflector.

Further, in the vehicle headlamp of the present invention (the invention according to claim 3), by means for solving the abovementioned problem, the light that is directly radiated from the light emitting chip of the semiconductor-type light source forward of the vehicle can be emitted forward of the vehicle as a predetermined additional light distribution pattern by means of a free curved lens of the optical member integrally structured with the mount member. In this manner, the vehicle headlamp of the present invention (the invention according to claim 3) is capable of effectively utilizing the light that is directly radiated from the light emitting chip of the semiconductor-type light source forward of the vehicle, i.e., ordinarily ineffective light.

Moreover, in the vehicle headlamp of the present invention (the invention according to claim 3), the optical member of the free curved lens is integrally structured with the mount member, and is mounted on the holding member via the mount member together with the semiconductor-type light source, so that the additional light distribution pattern can be controlled to be optically distributed with high precision by means of the free curved lens of the optical member.

Furthermore, in the vehicle headlamp of the present invention (the invention according to claim 4), by means for solving the abovementioned problem, the light that is directly radiated from the light emitting chip of the semiconductor-type light source forward of the vehicle, i.e., light which is not controlled to be optically distributed, can be reliably shaded by means of a shade of the optical member integrally structured with the mount member.

Moreover, in the vehicle headlamp of the present invention (the invention according to claim 4), the optical member of the shade is integrally structured with the mount member, and is mounted on the holding member via the mount member together with the semiconductor-type light source, so that the light that is not controlled to be optically distributed is reliably shaded by means of the shade of the optical member, and can be prevented from being emitted forward of the vehicle.

DESCRIPTION OF THE PREFERRED EMBODIMENTS

Figure 18:
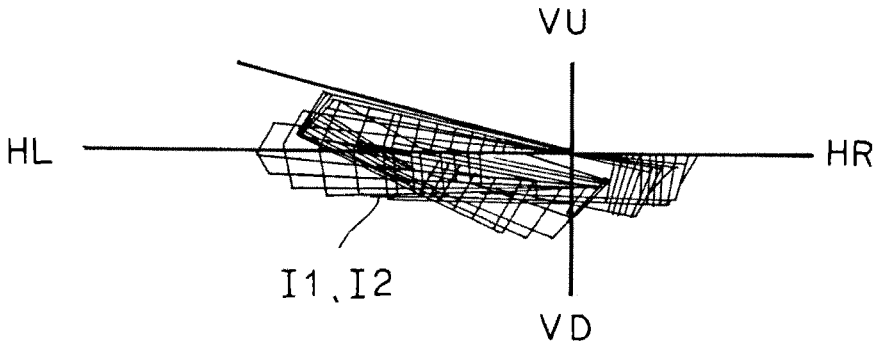
FIG. 18 is an explanatory view showing a reflection image group of a light emitting chip, the reflection image group being obtained by the first reflection surface that is made up of the fourth segment, similarly.
Figure 19:
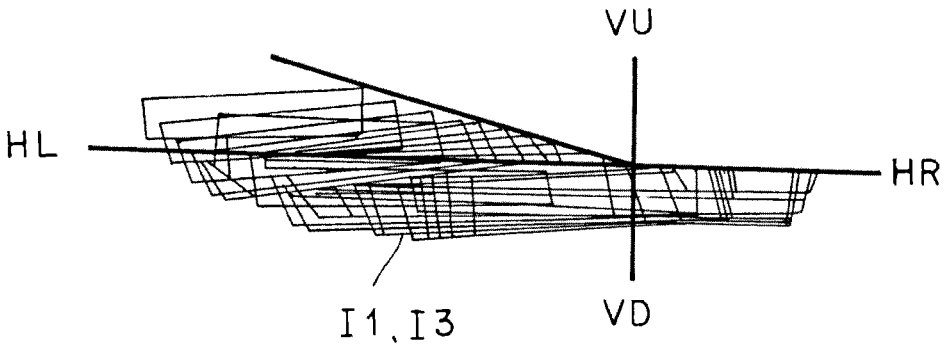
FIG. 19 is an explanatory view showing a reflection image group of a light emitting chip, the reflection image group being obtained by the second reflection surface that is made up of the fifth segment, similarly.

Hereinafter, first to fifth embodiments of the preferred embodiments of a vehicle headlamp according to the present invention will be described in detail with reference to the drawings. It should be noted that the present invention is limited by the embodiments. In FIG. 4 to FIG. 6, FIG. 21, FIG. 22, FIG. 32, FIG. 33, FIG. 37 and FIG. 38, a heat sink member is not shown. FIG. 18 and FIG. 19 are explanatory views showing a reflection image group of a light emitting chip on a screen, which is obtained through a computer simulation. In FIG. 18 to FIG. 20, FIG. 29, FIG. 34 and FIG. 39, the letter sign "VU-VD" designates a vertical line of a top and a bottom of a screen; and the letter sign "HL-HR" designates a horizontal line of a left and a right of the screen. In the specification and claims, the terms "top", "bottom", "front", "rear", "left", and "right" designate the top, bottom, front, rear, left, and right of a vehicle when the vehicle headlamp according to the present invention is mounted on a vehicle (an automobile).

First Embodiment

Configuration of the Vehicle Headlamp

Figure 20:
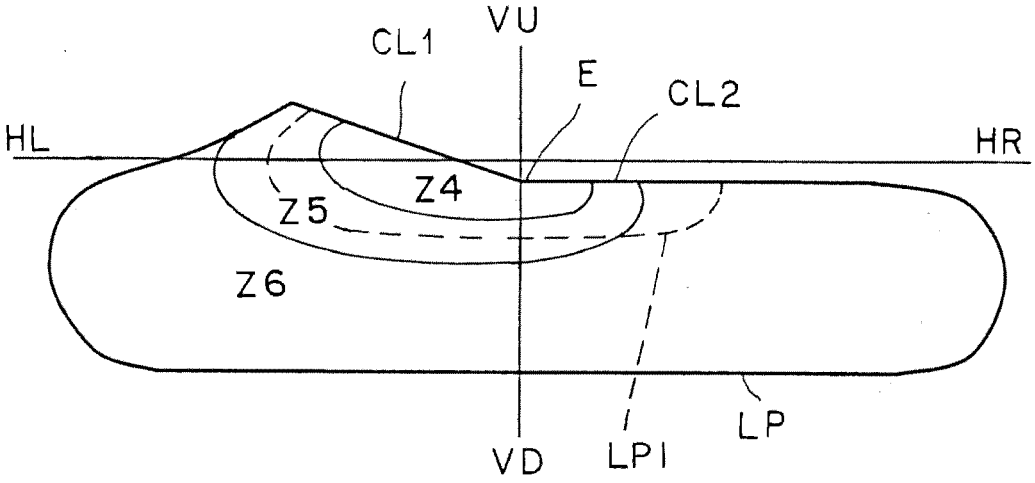
FIG. 20 is an explanatory view showing a light distribution pattern for low beam, the pattern having an oblique cutoff line and a horizontal cutoff line, similarly.
Figure 21:
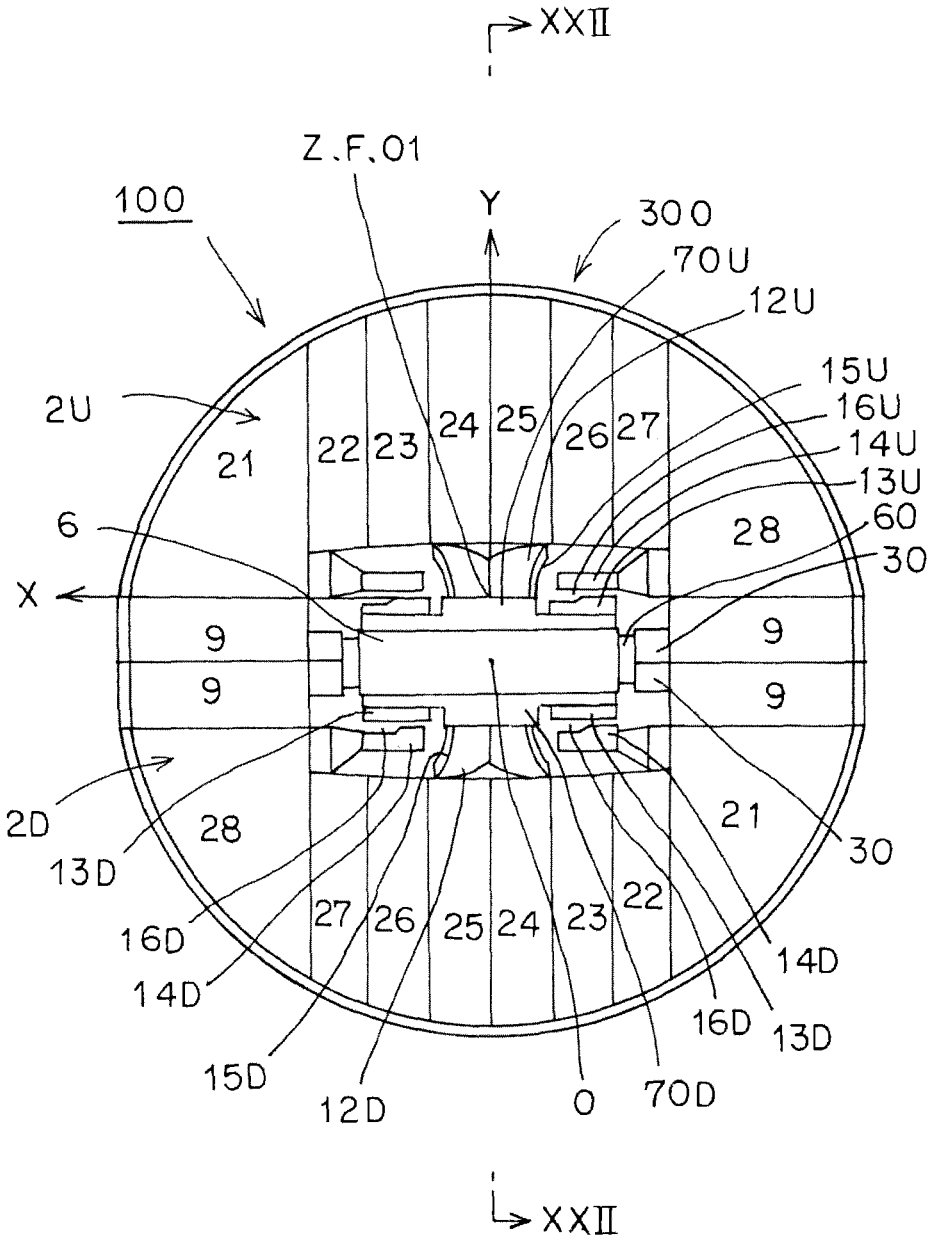
FIG. 21 is a front view of the essential portions (the semiconductor-type light source, the reflector, the holding member, the mount member, the optical member) showing a vehicle headlamp according to a second embodiment of the present invention.
Figure 22:
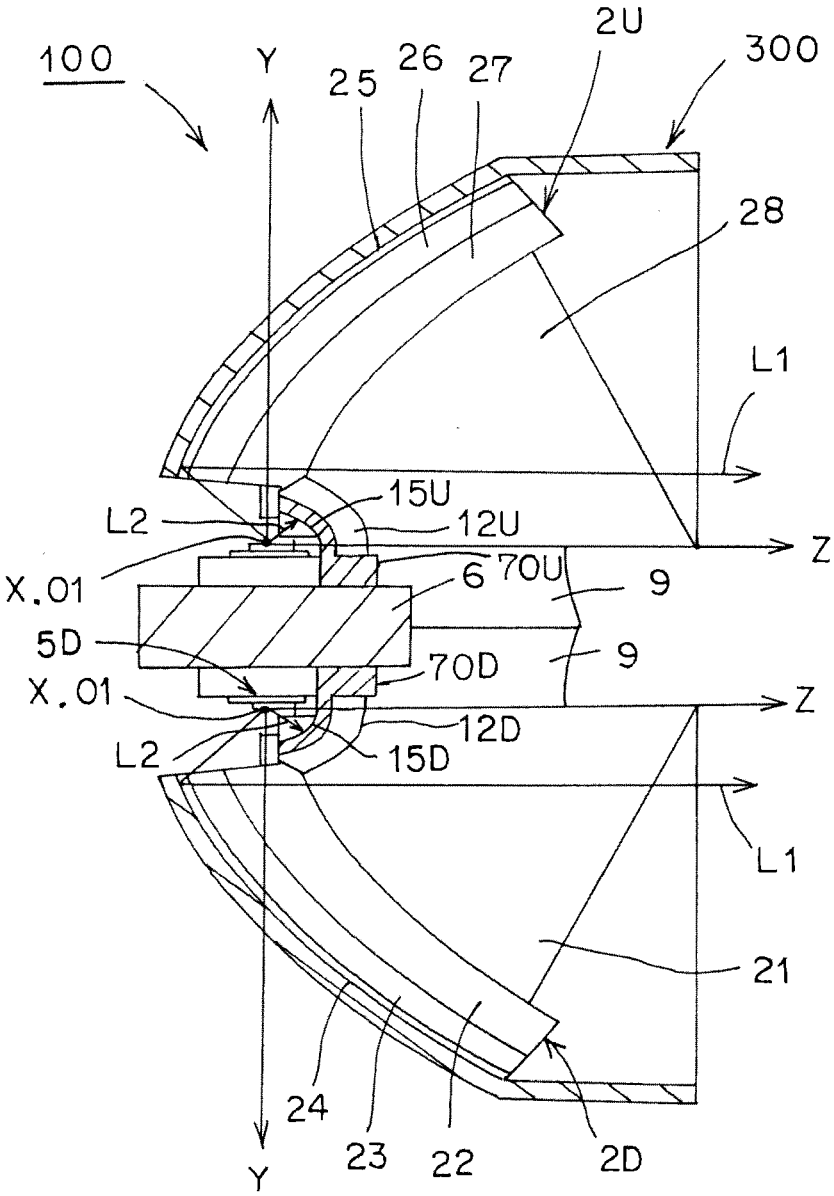
FIG. 22 is a sectional view of the essential portions taken along the line XXII-XXII in FIG. 21, similarly.
Figure 23:
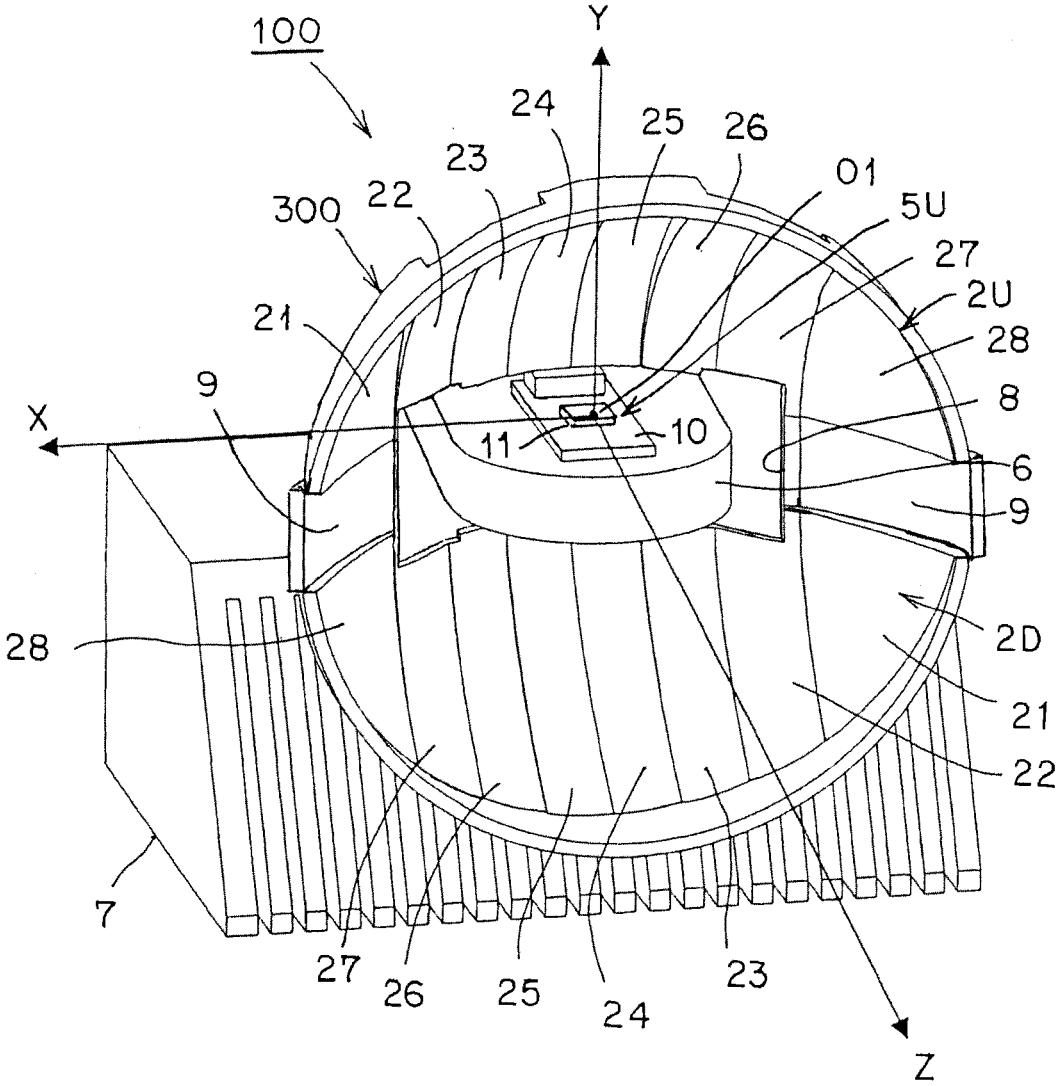
FIG. 23 is a perspective view showing essential portions in a state in which a light shading member, a first additional reflection surface, and at least one shade are removed, similarly.
Figure 24:
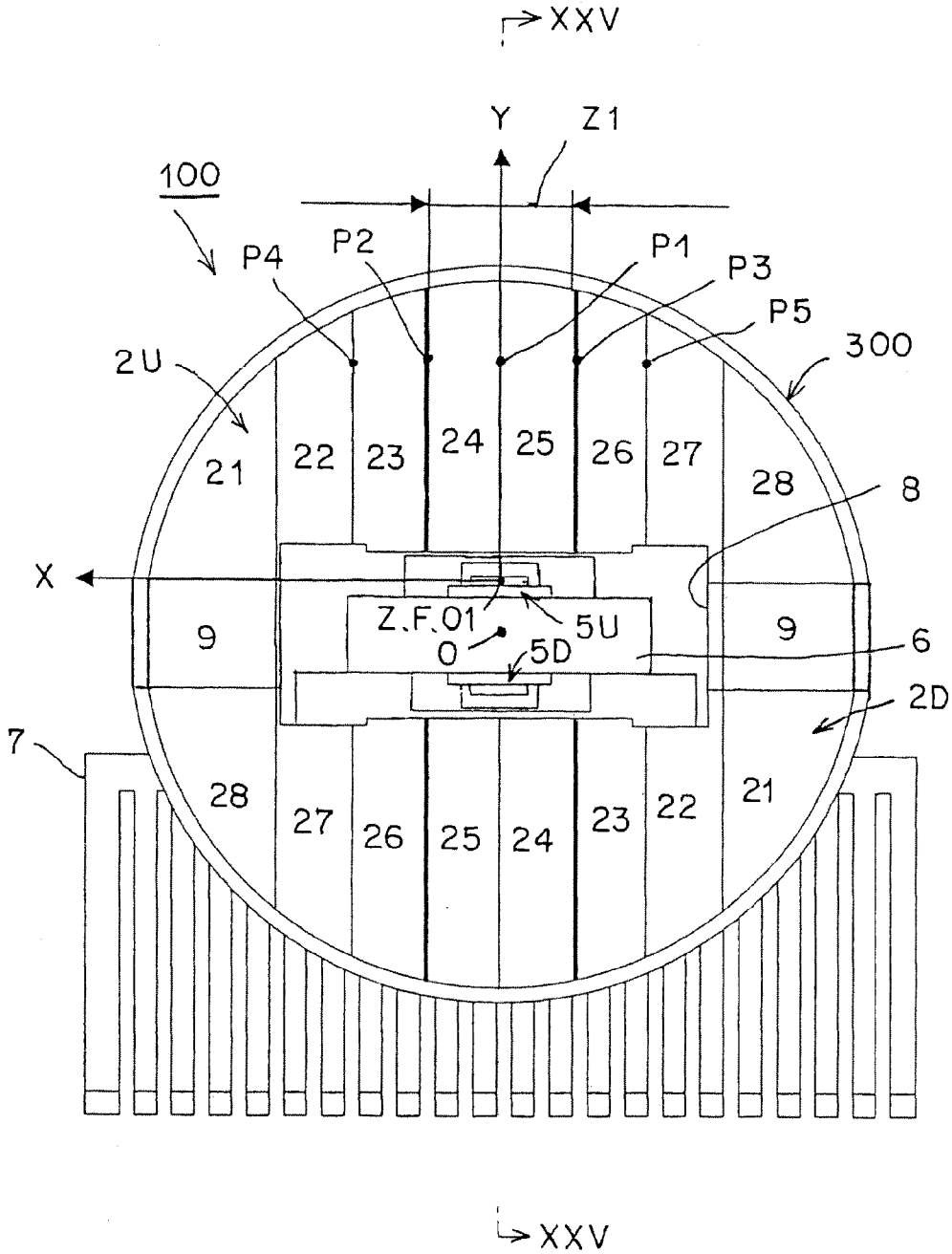
FIG. 24 is a front view showing the essential portions (the semiconductor-type light source, the reflector, the holding member, the heat sink member) in the state in which the light shading member, the first additional reflection surface, and the shade are removed, similarly.
Figure 25:
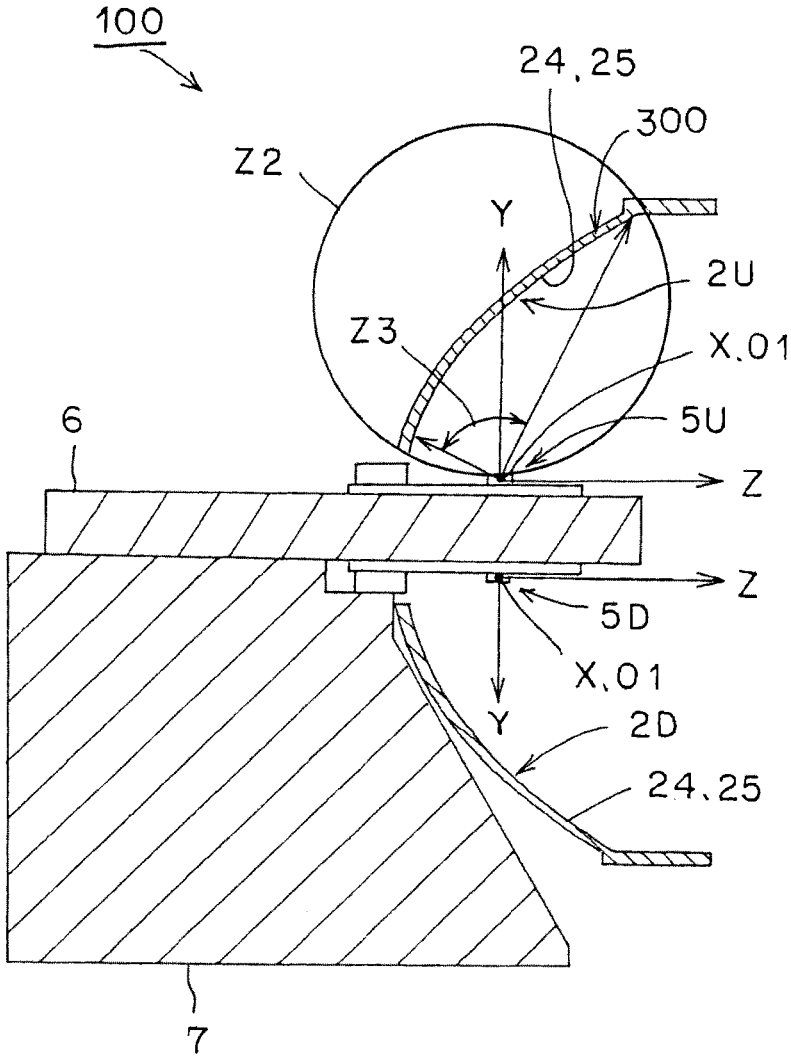
FIG. 25 is a sectional view of the essential portions, taken along the line XXV-XXV in FIG. 24, similarly.

FIG. 1 to FIG. 20 show a vehicle headlamp according to a first embodiment of the present invention. Hereinafter, a configuration of the vehicle headlamp in the first embodiment will be described. In the figures, reference numeral 1 designates the vehicle headlamp (an automobile headlamp) in the first embodiment. The vehicle headlamp 1, as shown in FIG. 20, has an oblique cutoff line CL1 on a running lane side (a left side) with an elbow point E being a turning point. This headlamp is also adapted to emit a light distribution pattern having a horizontal cutoff line CL2, for example, a light distribution pattern for low beam (a light distribution pattern for passing) LP to an opposite lane side (a right side), i.e., to a forward direction of a running vehicle. An angle formed between the oblique cutoff line CL1 and a horizontal line HL-HR of a screen is about 15 degrees.

The vehicle headlamp 1 is comprised of: a reflector 3 having an upside main reflection surface 2U as a reflection surface which is made of a parabola-based free curved face (NURBS-curved face) and second additional reflection surfaces 9, 9 as additional reflection surfaces which are made of parabola-based free curved faces; an upside semiconductor-type light source 5U as a semiconductor-type light source having a light emitting chip 4 which is formed in a planar rectangle shape (a planar elongated shape); a holder 6 as a holding member; a heat sink member 7; an upside mount member 70U; a light shading member 12U having first additional reflection surfaces 15U, 15U as additional reflection surfaces which are made of an elliptical free curved face as an upside optical member; two of shades 13U, 13U, 14U, 14U as upside optical members, similarly; and a lamp housing and a lamp lens (such as a transparent outer lens, for example), although not shown.

The mount member 70U, the light shading member 12U as an optical member, i.e., the first additional reflection surfaces 15U, 15U, and the two first shades 13U, 13U as optical members form an integrated structure, similarly. In addition, the reflector 3 and the two second shades 14U, 14U form an integrated structure. The reflector 3 and the two second shades 14U, 14U that are integrally structured therewith are fixedly held by means of the holder 6. The upside semiconductor-type light source 5U is mounted on the holder 6 by means of the mount member 70U. The light shading member 12U as the optical member, i.e., the first additional reflection surfaces 15U, 15U and the first two shades 13U, 13U are mounted on the holder 6 by means of the mount member 70U which is integrally structured therewith. In addition, the holder 6 is mounted on the heat sink member 7.

The reflector 3, the upside semiconductor-type light source 5U, the holder 6, the heat sink member 7, the mount member 70U, the light shading member 12U, and two shades 13U, 13U, 14U, 14U form a lamp unit. The lamp unit formed by these constituent elements assigned by reference numerals 3, 5U, 6, 7, 70U, 12U, 13U, 13U, 14U, 14U is disposed in a lamp room partitioned by the lamp housing and the lamp lens, for example, via an optical axis adjustment mechanism. In the lamp room, there may be disposed another lamp unit such as a fog lamp, a cornering lamp, a clearance lamp, or a turn signal lamp other than the lamp unit formed by the constituent elements assigned by reference numeral 3, 5U, 6, 7, 70U, 12U, 13U, 13U, 14U, 14U.

Of the lamp unit formed by the constituent elements assigned by reference numeral 3, 5U, 6, 7, 70U, 12U, 13U, 13U, 14U, 14U, light reflection processing is applied to: the upside main reflection surface 2U; the second additional reflection surfaces 9, 9 of the reflector 3; and the first additional reflection surfaces 15U, 15U of the light shading member 12U. In addition, of the lamp unit formed by the constituent elements assigned by reference numerals 3, 5U, 6, 7, 70U, 12U, 13U, 13U, 14U, 14U, light shading processing is applied to at least the two shades 13U, 13U, 14U, 14U.

The upper main reflection surface 2U, the upper semiconductor-type light source 5U, the upper light shading member 12U, and the upper two shades 13U, 13U, 14U, 14U constitute an upside unit in which a light emitting surface of the light emitting chip 4 is oriented upward in a vertical Y-axis direction.

Figure 1:
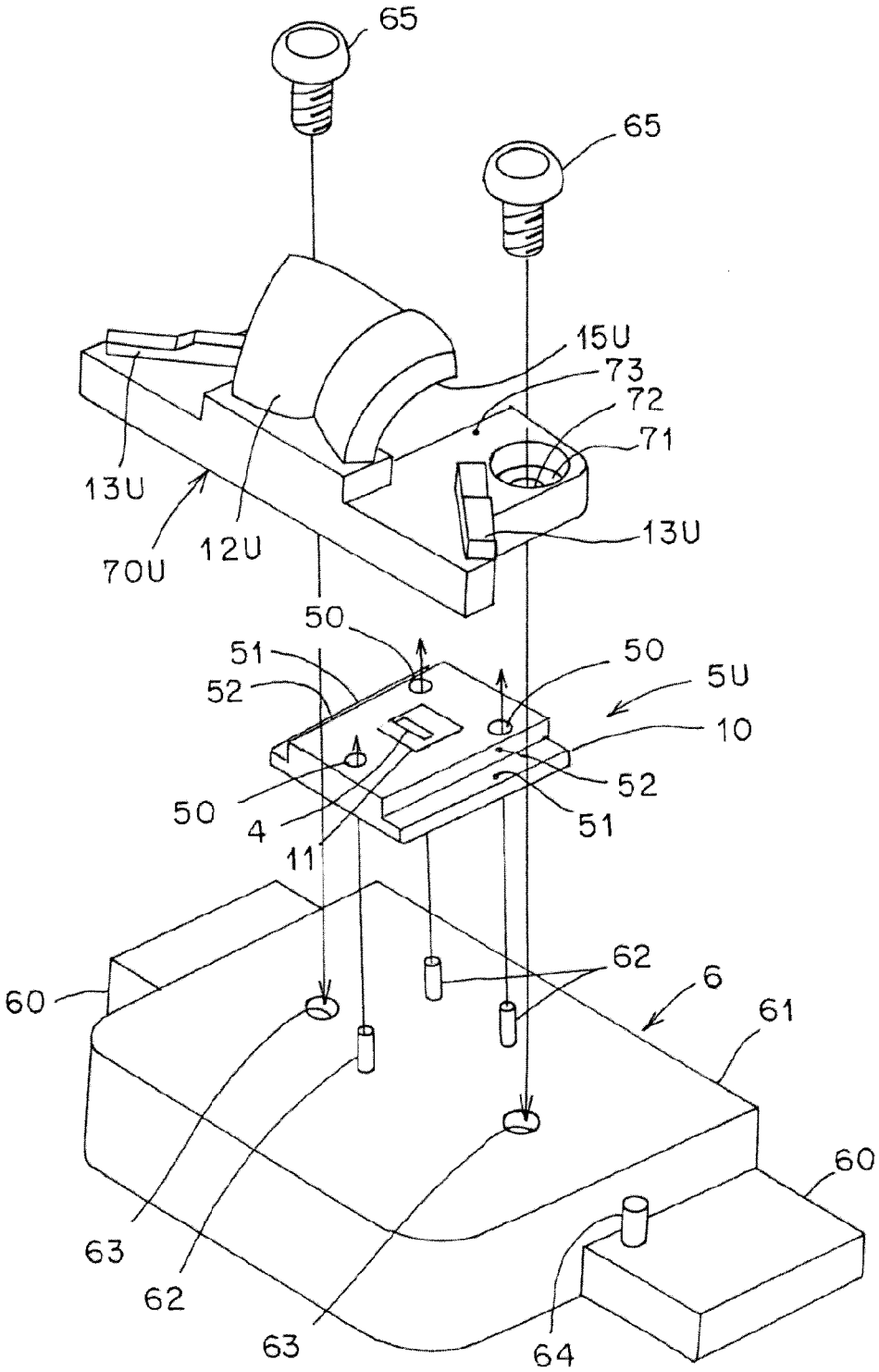
FIG. 1 is an exploded perspective view of the essential portions (a semiconductor-type light source, a holding member, a mount member, an optical member) showing a vehicle headlamp according to a first embodiment of the present invention.
Figure 2:
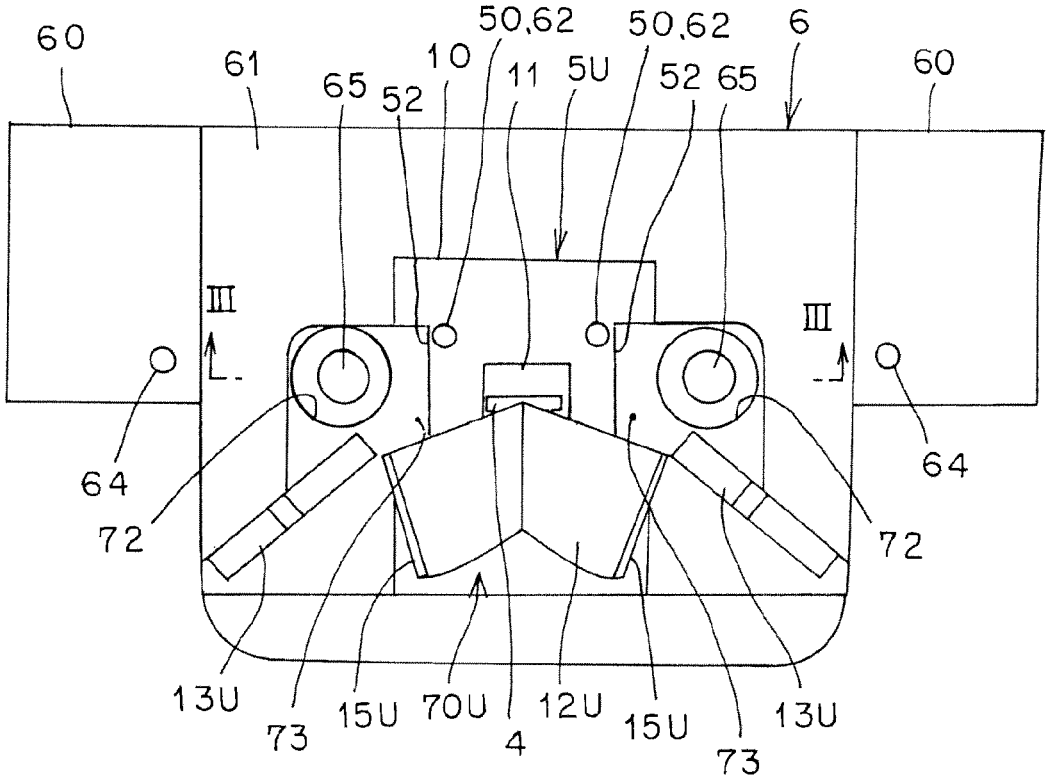
FIG. 2 is a plan view showing mounting state of the essential portions (the semiconductor-type light source, the holding member, the mount member, the optics member), similarly.
Figure 3:
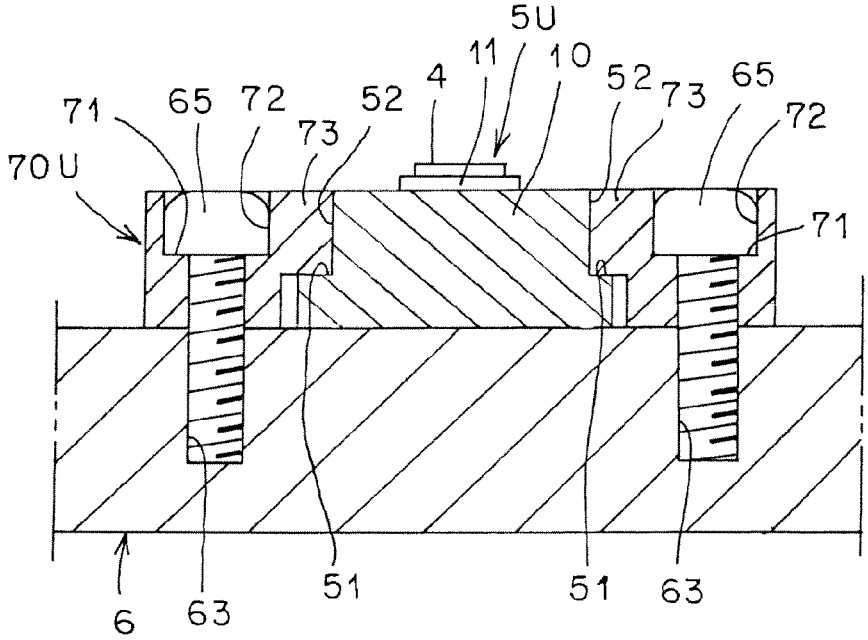
FIG. 3 is a sectional view of the essential portions, taken along the line in FIG. 2, similarly.
Figure 4:
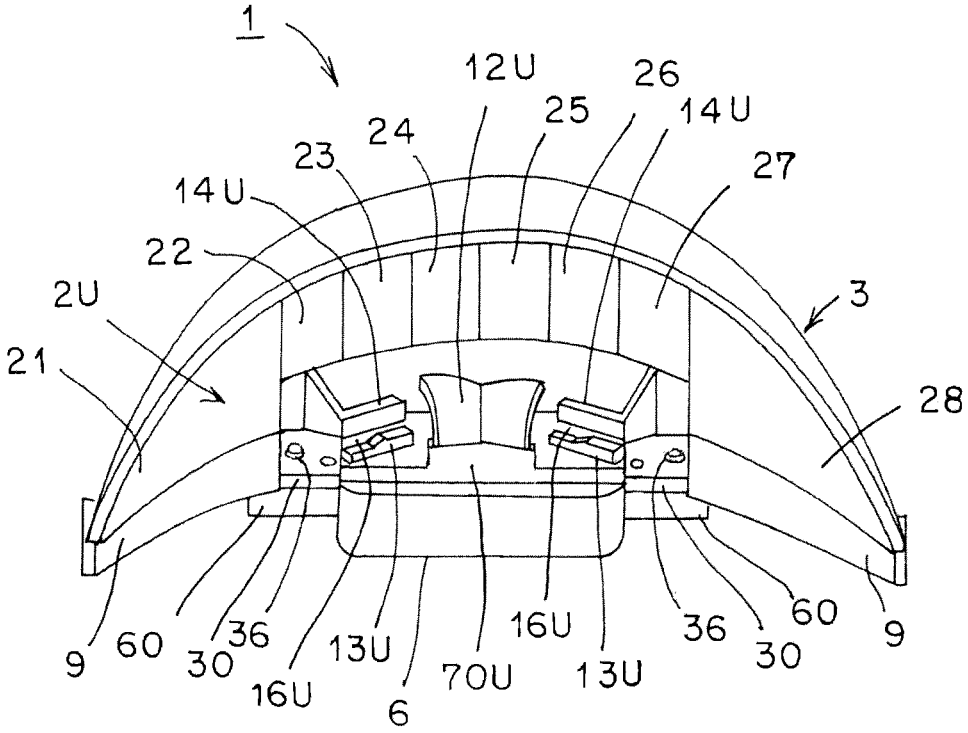
FIG. 4 is a perspective view showing the essential portions (the semiconductor-type light source, a reflector, the holding member, the mount member, the optical member), similarly.
Figure 5:
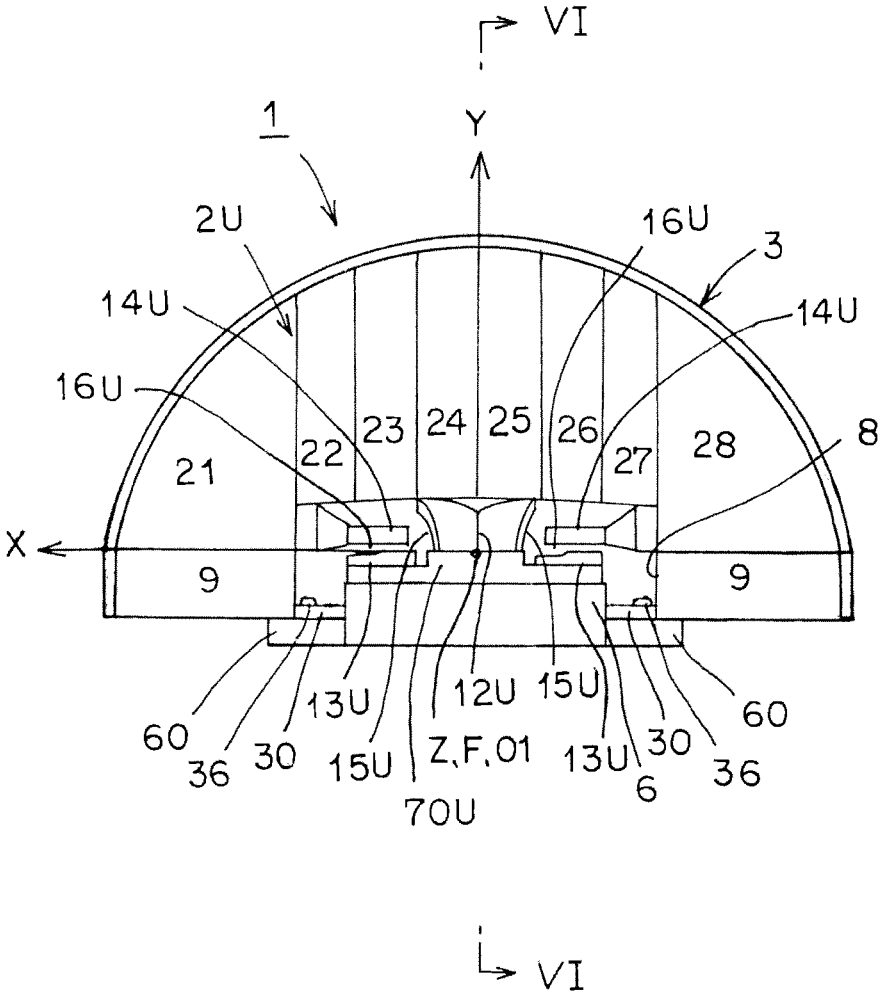
FIG. 5 is a front view showing the essential portions (the semiconductor-type light source, the reflector, the holding member, the mount member, the optical member), similarly.
Figure 6:
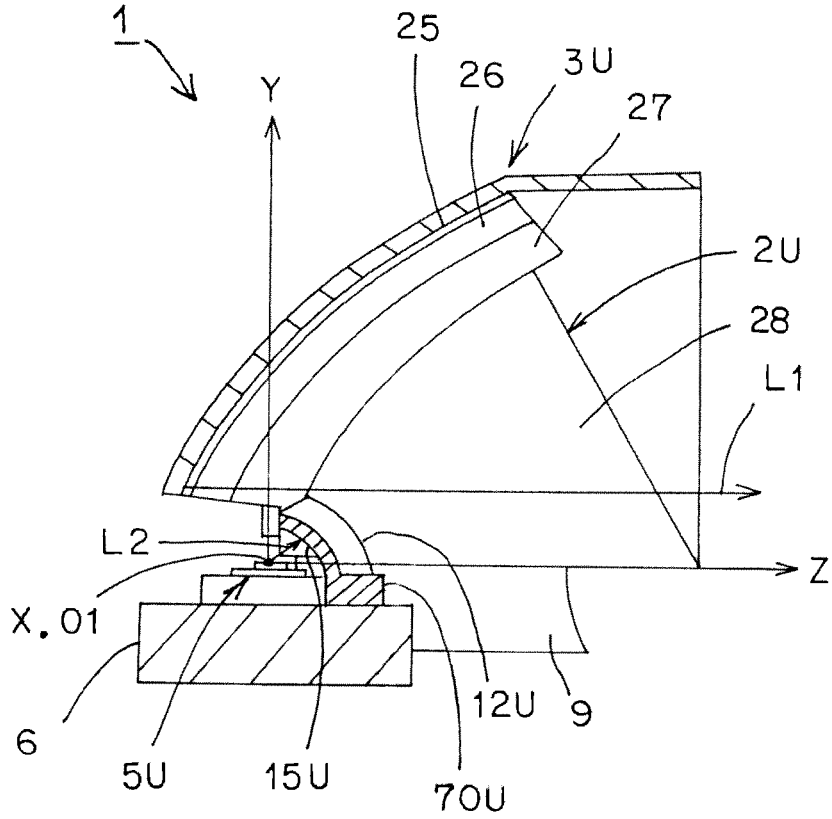
FIG. 6 is a sectional view of the essential portions, taken along the line VI-VI in FIG. 5, similarly.

The reflector 3, as shown in FIG. 4 to FIG. 6, is fixedly held by means of the holder 6. In other words, a fixing portion 30 and a fixing portion 60 are integrally provided at each of the left and right sides of a window portion 8 of the reflector 3 and at each of the left and right sides of a main body 61 of the holder 6. The fixing portion 30 of the reflector 3 is fixedly held by means of a screw 36 and a fixing member (elastic engagement between an elastic claw and an engagement portion, a so called patching engagement) in a state in which the fixing portion is positioned at the fixing portion 60 of the holder 6 by means of positioning means.

The positioning means is comprised of: a small circular through hole which is provided at the fixing portion 30 of the reflector 3; and a small cylindrical first pin 64 which is integrally provided at the fixing portion 60 of the holder 6, and is the one that forms positioning between the reflector 3 and the holder 6 by inserting the first pin 64 into the through hole.

The reflector 3 is made up of an optically opaque resin member, for example. The reflector 3 forms a portion corresponding to an upper half of a substantial rotational parabolic face on which an axis passing through a center point (not shown) is defined as a rotary axis. A front side of the reflector 3 is opened in a substantially semicircular shape of the upper half. The size of an opening at the front side of the reflector 3 is equal to or smaller than about 100 mm in diameter. On the other hand, a rear side of the reflector 3 is closed. The window portion 8 that is formed in the shape of a substantially transversely elongated rectangle is provided at an intermediate part of the closed portion of the reflector 3. Two of the second shades 14U, 14U are integrally provided at an edge portion on both left and right side of the window portion 8 of the reflector 3.

Among inside (front-side) faces of the closed potion of the reflector 3, the upper main reflection surface 2U is provided on an upper face of the window portion 8. The upper main reflection surface 2U made up of a parabolic free curbed face (a NURBS curved face) has a reference focal point (a pseudo focal point) F and a reference optical axis (a pseudo optical axis) Z. Among the interior (front) faces of the closed portion of the reflector 3, both of the left and right faces of the window portion 8 being faces defined at a lower portion of the upper main reflection surface 2U are faces which the light radiated from a light emitting surface of the light emitting chip 4 of the upper semiconductor-type light source 5U does not reach surfaces.

The upside semiconductor-type light source 5U, as shown in FIG. 1 to FIG. 3 and FIG. 6, is fixedly held by means of the mount portion 70U and a screw 65 in a state in which the light source is positioned on a top fixing face of the main body 61 of the holder 6 by means of positioning means.

In other words, the upside semiconductor-type light source 5U is comprised of: an insulation member 10; a board 11 which is provided on a top fixing face of the insulation member 10; and the light emitting chip 4 which is provided on the top fixing face of the board 11 via a sealing resin member (not shown). On the board 11, circuits or parts for controlling a current to be supplied to the light emitting chip 4 or parts or the like are mounted. A plurality of, in this example, three small circular through holes 50 for positioning are provided at the insulation member 10 of the upside semiconductor-type light source 5U. In addition, a plurality of, in this example, two elongated recessed portions 52 having stepped portions 51 are provided at the insulation member 10 of the upside semiconductor-type light source 5U.

A plurality of, in this example, three small cylindrical second pins 52 for positioning are integrally provided on the top fixing face of the main body 61 of the holder 6. In addition, a plurality of, in this example, two small circular through holes 63 are provided on the top fixing face of the main body 61 of the holder 6. Further, a connector portion (not shown) is provided at the main body 61 of the holder 6. A power source side connector is electrically connected to the connector portion of the holder 6, whereby a current can be supplied to the light emitting chip 4 of the upside semiconductor-type light source 5U.

The mount member 70U is comprised of a resin member or a metal member having its high thermal conductivity, for example. The light shading member 12U as an optical member, i.e., the first additional reflection surfaces 15U, 15U are integrally provided at a forward side of a central part on a top fixing face of the mount member 70U. In addition, the two first shades 13U, 13U are integrally provided at a forward side of each of the left and right end parts on the top fixing face of the mount member 70U. Further, a plurality of, in this example, two circular through holes 72 having stepped portions 71 are provided at a rear side of each end part of the mount member 70U. Furthermore, a plurality of, in this example, two elongated protrusive portions 73 are integrally provided at both of the left and right edge parts of a rear side opening portion at the central part of the mount member 70U.

The second pin 62 of the holder 6 is inserted into the through hole 50 of the upside semiconductor-type light source 5U and then the upside semiconductor-type light source 5U is placed in a state in which the light source is positioned on the top fixing face of the main body 61 of the holder 6. In this state, the protrusive portion 73 of the mount member 70U is placed on the stepped portion 51 of the recessed portion 52 of the upside semiconductor-type light source 5U. In this state, a screw 65 is inserted into a through hole 72 of the mount member 70U and then is screwed into the through hole 63 of the holder 6. A head part of the screw 65 comes into pressure contact with a top of the stepped portions 71 of the through hole 72 of the mount member 70U. As a result, the upside semiconductor-type light source 5U is fixedly held by means of the mount member 70U and the screw 65, both of which are integrally structured with the light shading member 12U as an optical member, i.e., the first additional reflection surfaces 15U, 15U and the two first shades 13U, 13U, in a state the light source is positioned on the top fixing face of the main body 61 of the holder 6.

The holder 6 is comprised of a resin member or a metal member having its high thermal conductivity, for example.

The heat sink member 7 is formed in a trapezoidal shape having a top fixing face at an upper part thereof, and is formed in the a fin-like shape from an intermediate part to a lower part thereof. The heat sink member 7 is comprised of a resin member or a metal member having its high thermal conductivity, for example. The holder 6 is fixedly held on the top fixing face of the heat sink member 7 by means of a fixing member (a screw or elastic engagement between an elastic claw and an engagement portion, a so called patching engagement), although not shown.

Figure 12:
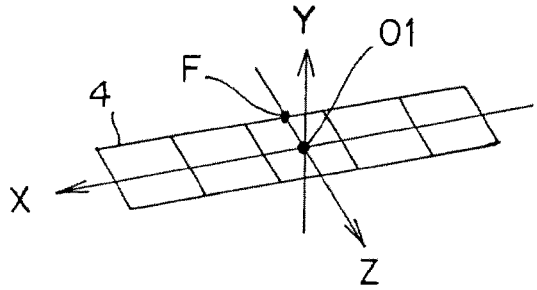
FIG. 12 is an explanatory perspective view showing the relative position relationship between the center of the light emitting chip and the reference focal point of the reflection surface, similarly.
Figure 13:
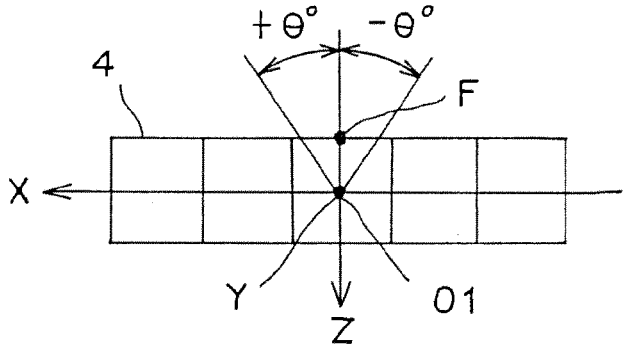
FIG. 13 is an explanatory plan view showing the relative position relationship between the center of the light emitting chip and the reference focal point of the reflection surface, similarly.

The light emitting chips 4 of the upside semiconductor-type light source 5U, as shown in FIG. 12 and FIG. 13, are the ones in which five square chips are arranged in a horizontal axis X direction. One rectangular chip may be used or a plurality of (two to four or six or more) chips may be used.

A center O1 of the light emitting chip 4 is positioned at or near a reference focal point F of the main reflection surface 2U and is positioned on a reference optical axis Z of the main reflection surface 2U. In addition, a light emitting surface of the light emitting chip 4 (a face on an opposite side to a face opposite to the board 10) is oriented in a vertical Y-axis direction. In other words, the light emitting surface of the light emitting chip 4 of the upper semiconductor-type light source 5U is oriented upward in the vertical Y-axis direction. Further, a longer edge of the light emitting chip 4 is parallel to the horizontal axis X that is orthogonal to the reference optical axis Z and the vertical axis Y.

The horizontal axis X, the vertical axis Y, and the reference optical axis Z constitute an orthogonal coordinate (an X-Y-Z orthogonal coordinate system) while the center O1 of the light emitting chip 4 is defined as an origin. In the horizontal axis X, in the case of the constituent elements of the upside unit, designated by reference numerals 2U, 5U, 12U, 13U, 13U, 14U, 14U, an upper side corresponds to a positive direction and a lower side corresponds to a negative direction. In the vertical axis Y, in the case of the upside unit, designated by reference numerals 2U, 5U, 12U, 13U, 13U, 14U, 14U, an upper side corresponding to a positive direction and a lower side corresponds to a negative direction. In the reference optical axis Z, in the case of the constituent elements of the upside unit, designated by reference numerals 2U, 5U, 12U, 13U, 13U, 14U, 14U, a front side corresponds to a positive direction and a rear side corresponds to a negative direction.

The main reflection surface 2U is made up of a parabolic free curved face (a NURBS curved face). The reference focal point F of the main reflection surface 2U is positioned on the reference optical axis Z and between the center O1 of the light emitting chip 4 and a longer edge at a rear side of the light emitting chip 4. In the embodiment, this focal point is positioned at the longer edge at the rear side of the light emitting chip 4. In addition, a reference focal length of the main reflection surface 2U is about 10 mm to 18 mm. The main reflection surface 2U is disposed in a range from a plane including the light emitting surface of the light emitting chip 4 (a plane including the horizontal axis X and the reference optical axis Z) to a space at a side opposite to the light emitting face of the light emitting chip 4 (an upward-oriented space of the vertical axis Y).

The main reflection surface 2U is made up of segments 21, 22, 23, 24, 25, 26, 27, 28 divided into eight sections in the vertical Y-axis direction. A fourth segment 24 of a center portion constitutes a first reflection surface. In addition, a fifth segment 25 of the center part constitutes a second reflection surface. Further, a first segment 21, a second segment 22, a third segment 23, a sixth segment 26, a seventh segment 27, and an eighth segment 28 of end parts constitute a third reflection surface.

Figure 10:
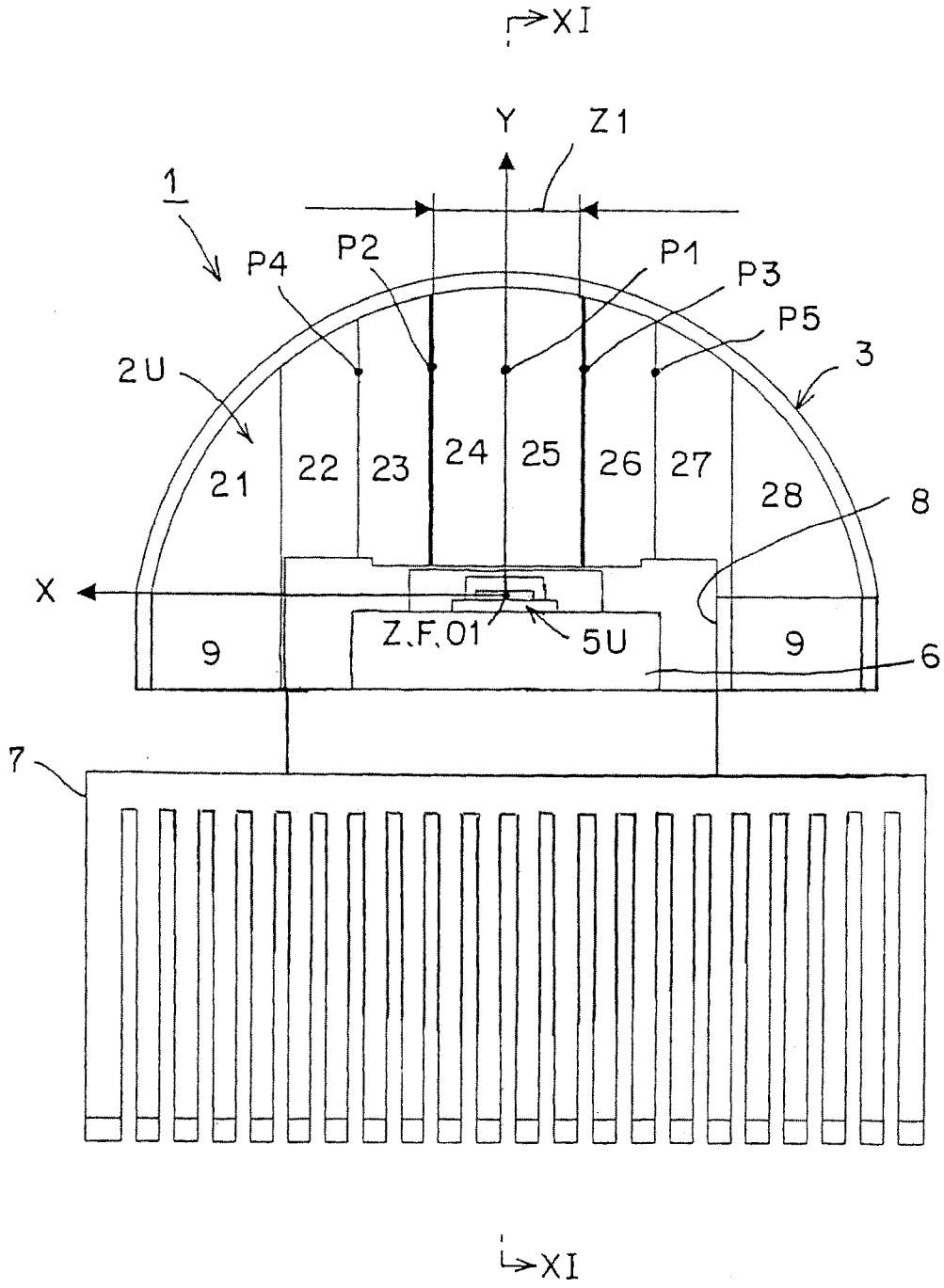
FIG. 10 is a front view showing the essential portions (the semiconductor-type light source, the reflector, the holding member, the heat sink member) in the state in which the light shading member, the first additional reflection surface, and the shade are removed, similarly.
Figure 14:
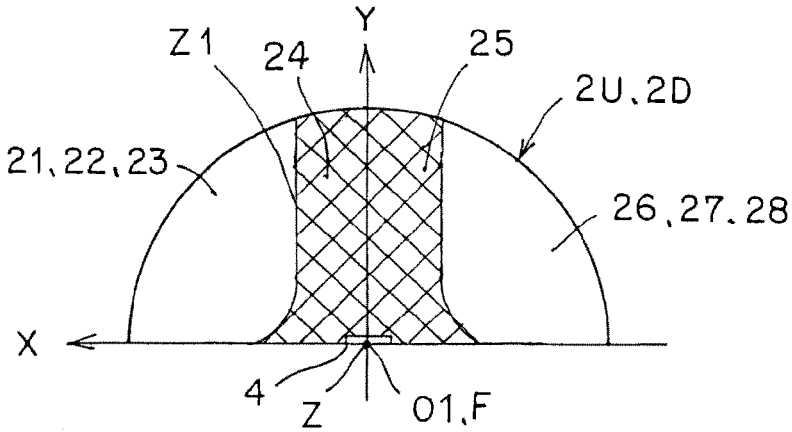
FIG. 14 is an explanatory front view showing a range in which a first reflection surface that is made up of a fourth segment and a second reflection surface that is made up of a fifth segment are provided, similarly.

The fourth segment 24 of the first reflection surface and the fifth segment 25 of the second reflection surface, of the center portion, is provided in a range Z1 between two longitudinal thick solid lines in FIG. 10 and in a range Z1 that is indicated by the lattice oblique lines in FIG. 14. In other words, these two segments are positioned in a range Z1 which is within a latitude angle of ∓40 degrees (∓θ degrees in FIG. 13) from the center O1 of the light emitting chip 4. The first segment 21, the second segment 22, the third segment 23, the sixth segment 26, the seventh segment 27, and the eighth segment 28 of the third reflection of the end parts are provided in a range that is indicated by a white-based color in FIG. 14 other than the range Z1. In other words, these six segments are provided within a range from the center O1 of the light emitting chip 4 to a latitude angle of ∓40 degrees or wider.

Figure 15:
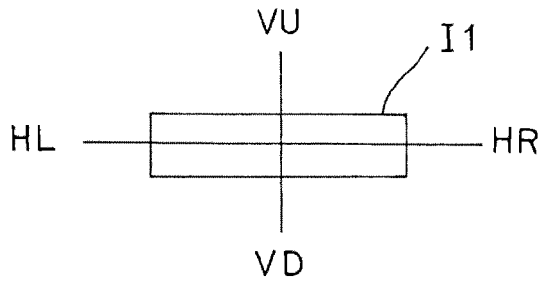
FIG. 15 is an explanatory view showing a reflection image of a light emitting chip, the reflection image being obtained at a point P1 of a reflection surface, similarly.
Figure 16:
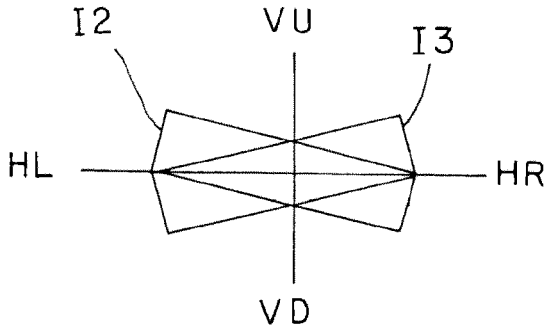
FIG. 16 is an explanatory view showing a reflection image of a light emitting chip, the reflection image being obtained at points P2, P3 of a reflection surface, similarly.
Figure 17:
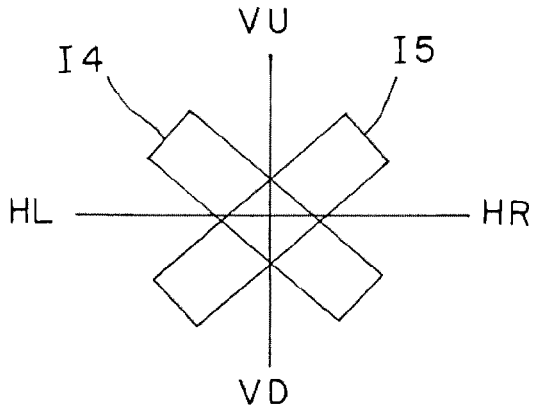
FIG. 17 is an explanatory view showing a reflection image of a light emitting chip, the reflection image being obtained at points P4, P5 of a reflection surface, similarly.

Hereinafter, with reference to FIG. 15, FIG. 16, and FIG. 17, a description will be given with respect to a reflection image (a screen map) of the light emitting chip 4 formed in a planar rectangle shape that is obtained in each of the segments 21 to 28 of the main reflection surface 2U. In other words, in a boundary P1 between a fourth segment 24 and a fifth segment 25, as shown in FIG. 15, a reflection image I1 of the light emitting chip 4 having a tilt angle of about 0 degree can be obtained with respect to a horizontal line HL-HR of a screen. In addition, in a boundary P2 between a third segment 23 and the fourth segment 24, as shown in FIG. 16, a reflection image I2 of the light emitting chip 4 having a tilt angle of about 20 degrees can be obtained with respect to the horizontal line HL-HR of the screen. Further, in a boundary P3 between a fifth segment 25 and a sixth segment 26, as shown in FIG. 16, a reflection image I3 of the light emitting chip having a tilt angle of about 20 degrees can be obtained with respect to the horizontal line HL-HR of the screen. Furthermore, in a boundary P4 between a second segment 22 and a third segment 23, as shown in FIG. 17, a reflection image I4 of the light emitting chip 4 having a tilt angle of about 40 degrees can be obtained with respect to a horizontal line HL-HR of the screen. Still furthermore, in a boundary P5 between a sixth segment 26 and a seventh segment 27, as shown in FIG. 17, a reflection image I5 of the light emitting chip 4 having a tilt angle of about 40 degrees can be obtained with respect to the horizontal line HL-HR of the screen.

As a result, in the fourth segment 24 of the main reflection surface 2U, reflection images from the reflection image I1 having the tilt angle of about 0 degrees shown in FIG. 15 to the reflection image I2 having the tilt angle of about 20 degrees shown in FIG. 16 can be obtained. In addition, in the fifth segment 25 of the main reflection surface 2U, reflection images from the reflection image I1 having the tilt angle of 0 degrees shown in FIG. 15 to the reflection image I3 having the tilt angle of about 20 degrees shown in FIG. 16 can be obtained. Further, in the third segment 23 of the main reflection surface 2U, reflection images from the reflection image I2 having the tilt angle of about 20 degrees shown in FIG. 16 to the reflection image I4 having the tilt angle of about 40 degrees shown in FIG. 17 can be obtained. Furthermore, in the sixth segment 26 of the main reflection surface 2U, reflection images from the reflection image I3 having the tilt angle of about 20 degrees shown in FIG. 16 to the reflection image I5 having the tilt angle of about 40 degrees shown in FIG. 17 can be obtained. Still furthermore, in the first segment 21, the second segment 22, the seventh segment 27, and the eighth segment 28, of the main reflection surface 2U, reflection images each having a tilt angle of 40 degrees or more can be obtained.

Here, the reflection images from the reflection image I1 having the tilt angle of about 0 degree shown in FIG. 15 to the reflection images I2, I3 each having the tilt angle of about 20 degrees shown in FIG. 16 are reflection images that are suitable to form a light distribution including an oblique cutoff line CL1 of the light distribution pattern LP for low beam. In other words, this is because the reflection images from the reflection image I1 having the tilt angle of about 0 degree to the reflection images I2, I3 each having the tilt angle of about 20 degrees are easily taken along the oblique cutoff line CL1 having a tilt angle of about 15 degrees. On the other hand, reflection images each having a tilt angle of about 20 degrees or more, including the reflection images I4, I5 each having the tilt angle of about 40 degrees shown in FIG. 17, are reflection images that are unsuitable to form the light distribution including the oblique cutoff line CL1 of the light distribution pattern LP for low beam. In other words, if a reflection image having a tilt angle of about 20 degrees or more is taken along the oblique cutoff line CL1 having the tilt angle of about 15 degrees, the resultant light distribution increases in thickness in a vertical direction, resulting in an excessive proximal light distribution (i.e., a light distribution that lowers in distal visibility).

Figure 11:
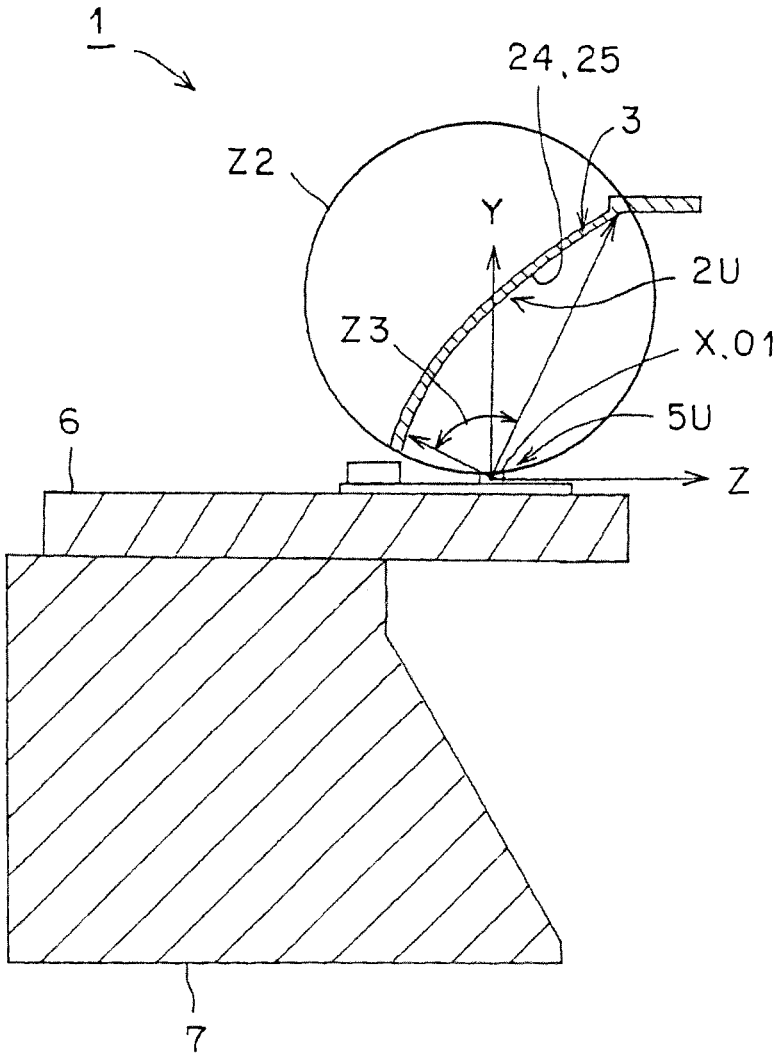
FIG. 11 is a sectional view of the essential portions, taken along the line XI-XI in FIG. 10, similarly.

In addition, a light distribution in the oblique cutoff line CL1 is responsible for a distally visible light distribution. Thus, there is a need to form a high luminous intensity zone (a high energy zone) for the light distribution in the oblique cutoff line CL1. Therefore, the fourth segment 24 of the first reflection surface and the fifth segment 25 of the second reflection surface, of the center portion, as shown in FIG. 11, are included in a high energy range Z3 in an energy distribution (Lambertian) Z2 of the light emitting chip 4.

From the foregoing description, the reflection surface that is suitable to form a light distribution in the oblique cutoff line CL1 is determined depending on a relative relationship between a range in which reflection images I1, I2 each having the tilt angle of 20 degrees or less can be obtained among reflection surfaces having parabolic free curved faces and the energy distribution (Lambertian) of the semiconductor-type light source 5U. As a result, the reflection surfaces that are suitable to form a light distribution in the oblique cutoff line CL1, i.e., the fourth segment 24 and the fifth segment 25 are provided in the range Z1 that is within the latitude angle of ∓40 degrees from the center O1 of the light emitting chip 4. These segments are also provided in a high energy range Z3 in the energy distribution (Lambertian) Z2 of the light emitting chip 4, the energy range Z3 being equivalent to a range in which there can be obtained the reflection images I1, I2 of the light emitting chip 4 whose tilt angle is within the tilt angle (about 20 degrees) that can be obtained by adding about 5 degrees to the tilt angle (about 15 degrees) of the oblique cutoff line CL1.

The first reflection surface that is made up of the forth segment 24, as shown in FIG. 18 and FIG. 20, is a reflection surface that is made up of a free curved face adapted to control the reflection images I1, I2 of the light emitting chip 4 to be optically distributed in a range Z4 in the light distribution pattern LP for low beam. This reflection surface is defined so that the reflection images I1, I2 of the light emitting chip 4 do not fly out from the oblique cutoff line CL1 and the horizontal cutoff line CL2. The above reflection surface is also defined so that a part of the reflection images I1, I2 of the light emitting chip 4 substantially comes into contact with the oblique cutoff line CL1 and the horizontal cutoff line CL2.

In addition, the second reflection surface that is made up of the fifth segment 25, as shown in FIG. 19 and FIG. 20, is a reflection surface that is made up of a free curved face for controlling the reflection images I1, I3 of the light emitting chip 4 to be optically distributed in a range Z5 containing the range Z4 in the light distribution pattern LP for low beam. This reflection surface is defined so that: the reflection images I1, I3 of the light emitting chip 4 do not fly out from the oblique cutoff line CL1 and the horizontal cutoff line CL2; and a part of the reflection images of the reflection images I1, I3 of the light emitting chip 4 substantially comes into contact with the oblique cutoff line CL1 and the horizontal cutoff line CL2. In addition, the above reflection surface is defined so that: the density of a group of the reflection images I1, I3 of the light emitting chip 4 is lower than that of a group of the reflection images I1, I2 of the light emitting chip 4, the images having been formed by the first reflection surface that is made up of the fourth segment 24; and the group of the reflection images I1, I3 of the light emitting chip 4 contains that of the reflection images I1, I2 of the light emitting chip 4, the images having been formed by the first reflection surface that is made up of the fourth segment 24. The density of one of the reflection images I1, I2 of the light emitting chip 4 is equal to or substantially equal to that of one of the reflection images I1, I3 of the light emitting chip 4.

Further, the third reflection surface that is made up of the first segment 21, the second segment 22, the third segment 23, the sixth segment 26, the seventh segment 27, and the eighth segment 28 is a reflection surface that is made up of a free curved face that is adapted to control reflection images I4, I5 of the light emitting chip 4 to be optically distributed in a range Z6 containing the ranges Z4, Z5 included in the light distribution pattern LP for low beam. This reflection surface is defined so that the reflection images I4, I5 of the light emitting chip 4 is substantially included in the light distribution pattern LP for low beam. In addition, the above reflection surface is defined so that the density of a group of the reflection images I4, I5 of the light emitting chip 4 is lower than that of the group of the reflection images I1,I2 of the light emitting chip 4, the images having been formed by the first reflection surface that is made up of the fourth segment 24 and that of the group of the reflection images I1, I3 of the light emitting chip 4, the images having been formed by the second reflection chip that is made up of the fifth segment 25. Further, the third reflection surface is defined so that and the group of the reflection images I4, I5 of the light emitting chip 4 contains that of the reflection images I1, I2 of the light emitting chip 4, the images produced by the first reflection surface that is made up of the fourth segment 24 and that of the reflection images I1, I3 of the light emitting chip 4, the image having been formed by the second reflection surface that is made up of the fifth segment 25.

One of the light shading members 12U, two of the first shades 13U, 13U, and two of the second shades 14U, 14U are arranged respectively separately, and as shown in FIG. 6, these elements are disposed in a space other than an optical path L1 that is emitted with light from the main reflection surface 2U to a forward direction of a vehicle. One of the light shading members 12U and one of the reflectors 3 are arranged respectively separately.

The light shading member 12U is provided in a range from a forward direction to an obliquely upward direction and from a forward direction to a slightly obliquely bilateral direction with respect to the light emitting chip 4. The light shading member 12U is made up of an optically opaque resin member or the like, for example. The light shading member 12U, as shown in FIG. 6, is a member adapted to shade light L2 that is directly radiated from a light emitting surface of the light emitting chip 4 to the forward direction of the vehicle.

Two of first additional reflection surfaces 15U, 15U are provided on an inside face of the light shading member 12U, i.e., on a face opposing to the light emitting surface of the light emitting chip 4. The two of first additional reflection surfaces 15U, 15U are made up of an elliptical free curved face on which: first reference focal points F1, F1 are positioned at or near a reference focal point F of the upper main reflection surface 2U. In other words, the first reference focal points F1, F1 are shared or substantially shared; second focal points F2, F2 are positioned at or in lower proximity to the horizontal axis X that is defined at both of the left and right sides with respect to the upper semiconductor-type light source 5U, and moreover, that is defined at the first reference focal point F of the upper main reflection surface 2U or at the frontal side more than the first reference focal point F1. The two of the first additional reflection surfaces 15U, 15U that are defined at both of the left and right sides are adapted to converge and reflect the light L2 at the second reference focal points F2, F2 the light L2 having been directly radiated from the light emitting surface of the light emitting chip 4 to the forward direction of the vehicle.

Figure 7:
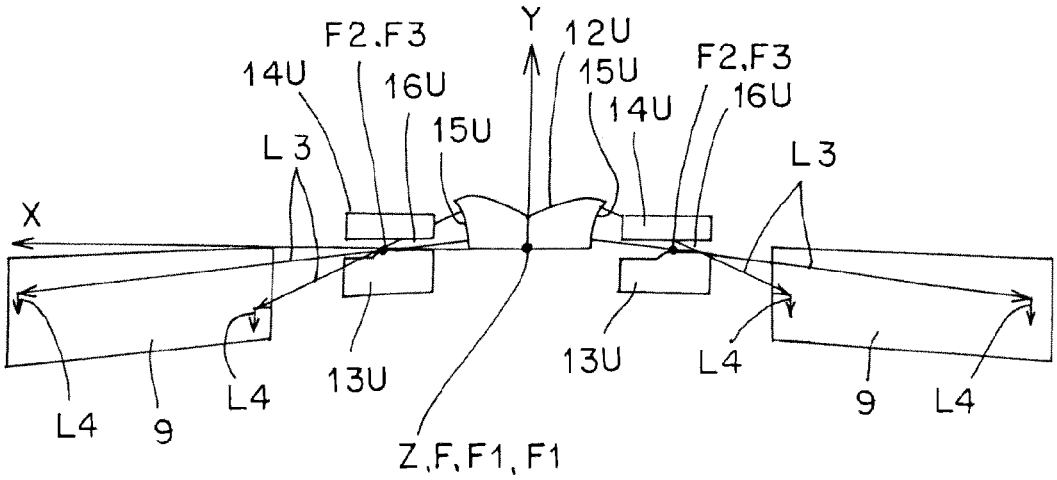
FIG. 7 is an explanatory front view showing an optical path of reflected light from a first additional reflection surface and reflected light from a second additional reflection surface, similarly.
Figure 8:
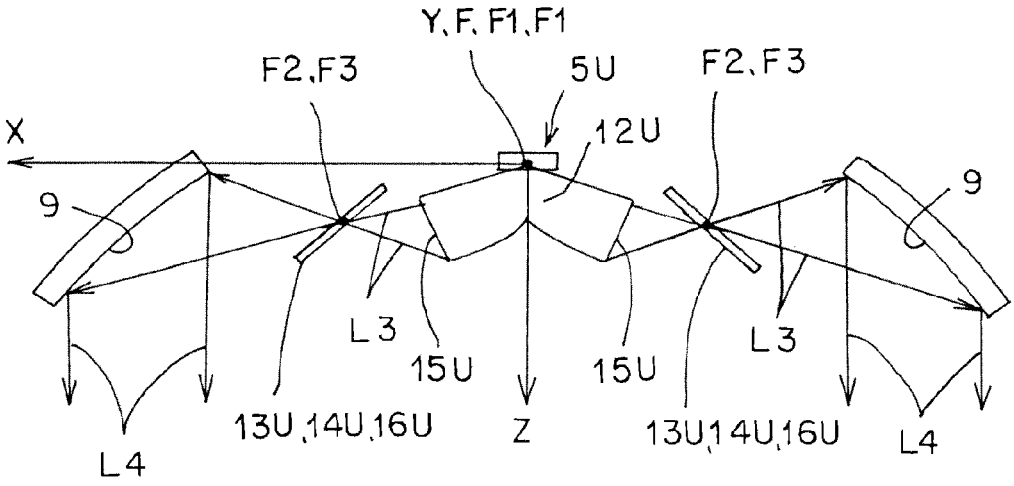
FIG. 8 is an explanatory front view showing an optical path of reflected light from a first additional reflection surface and reflected light from a second additional reflection surface, similarly.
Figure 9:
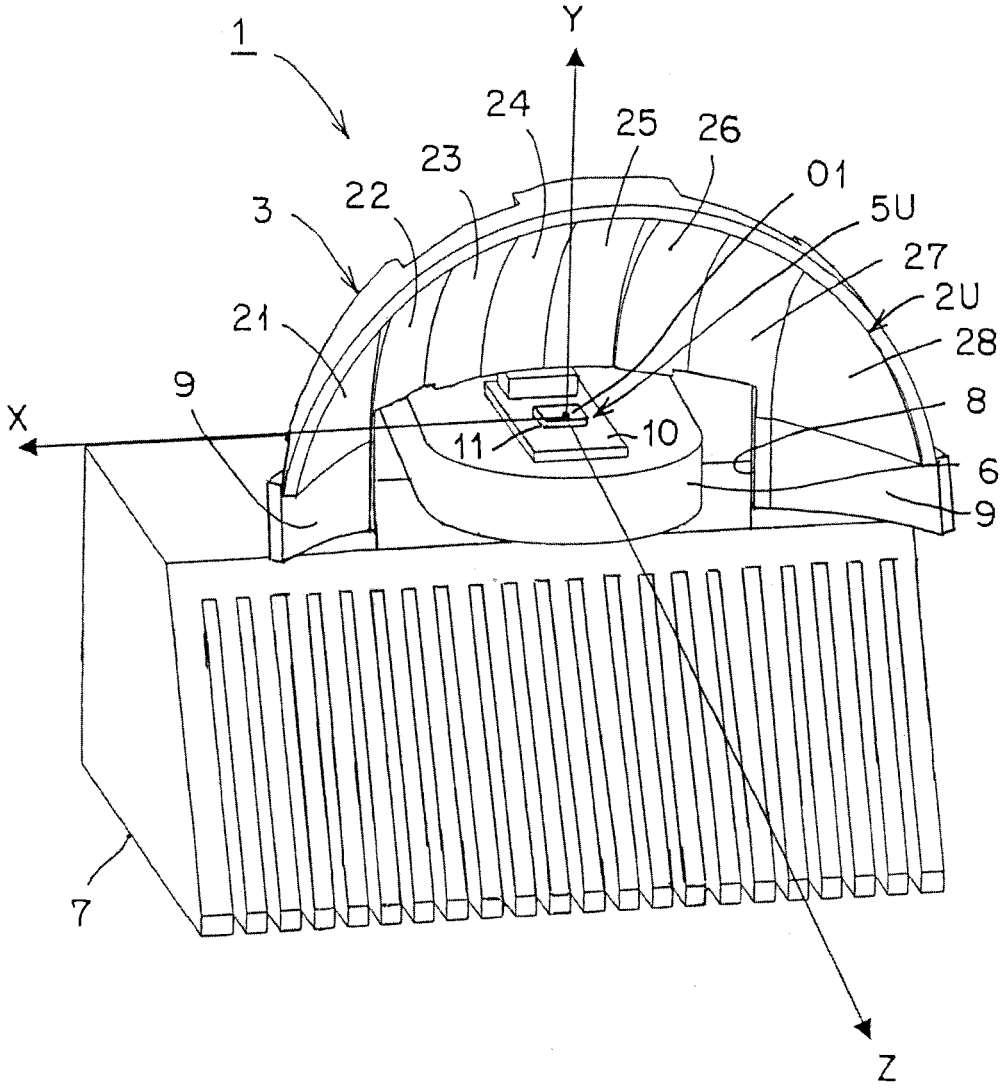
FIG. 9 is a perspective view showing the essential portions (the semiconductor-type light source, the reflector, the holding member, a heat sink member) in the state in which the light shading member, the first additional reflection surface, and the shade are removed, similarly.

Among inside (front-side) faces of the reflector 3, on the non-luminous faces 9, 9 that are faces defined at both of the left and right sides of the window portion 8 and defined at the lower part of the upper main reflection surface 2U, i.e., that are sites other than the upper main reflection surface 2U of the reflector 3 and faces that are positioned at both of the left and right sides with respect to the upper semiconductor-type light source 5U that is downward of the upper main reflection surface 2U, there are provided two of the second additional reflection surfaces that are surface that is made up of parabolic free curved faces on which reference focal points F3, F3 are positioned at or near the second reference focal points F2, F2 of the two of the first additional reflection surfaces 15U, 15U, respectively. The two of the second additional reflection surfaces 9, 9 that are defined at both of the left and right sides, as shown in FIG. 7 and FIG. 8, are adapted to reflect the reflected light L3 from the two of the first additional reflection surfaces 15U, 15U and then emit the reflected light L4 to the forward direction of the vehicle as a predetermined additional light distribution pattern, in the embodiment an additional light distribution pattern LP1 having cutoff lines CL1, CL2 (the light distribution pattern enclosed by the dashed line in FIG. 20). While the reflected light L4 in FIG. 7 is indicated by the downward-oriented arrow, the light is actually emitted slightly downward in the forward direction of the vehicle.

The two first shades 13U, 13U that are integrally structured with the mount member 70U and the two second shades 14U, 14U that are integrally structured with the reflector 3 are disposed between the two first additional reflection surfaces 15U, 15U (the light shading member 12U) and the two second additional reflection surfaces 9, 9 and at or near second reference focal points F2, F2 of the two first additional reflection surfaces 15U, 15U and reference focal points F3, F3 of the two second additional reflection surfaces 9, 9. The two first shades 13U, 13U at both of the left and right sides and the two second shades 14U, 14U at both of the left and right sides are comprised of an optically opaque resin member or the like. At respective ones of the two first shades 13U, 13U and the two second shades 14U, 14U, two opening portions 16U, 16U are provided for forming the additional light distribution pattern LP1 having the cutoff lines CL1, CL2 while reflected light L3 is optically transmitted from the two first additional reflection surfaces 15U, 15U. Upper edges of the two opening portions 16U, 16U at both of the left and right sides, i.e., lower edges of the two second shades 14U, 14U form a horizon. Lower edges of the two opening portions 16U, 16U, i.e., upper edges of the two first shades 13U, 13U form a differently stepped horizon where a right side half is lowered by one step relative to a left side half.

The additional light distribution pattern LP1 is controlled to be optically distributed in a range containing a part of the range Z4 and the range Z5 in the light distribution pattern LP for low beam. The cutoff lines CL1, CL2 of the additional light distribution pattern LP1 coincide with the cutoff lines CL1, CL2 of the light distribution pattern LP for low beam.

(Functional Description)

The vehicle headlamp 1 in the embodiment is made up of the above-described constituent elements. Hereinafter, a functional description will be given.

First, a light emitting chip 4 of an upper semiconductor-type light source 5U of a vehicle headlamp 1 is illuminated to emit light. As shown in FIG. 6, light is then radiated from an upward light emitting surface of the light emitting chip 4 of the upper semiconductor-type light source 5U. A part of the light (the light in a range Z3 of high energy in an energy distribution (Lambertian) Z2 of the light emitting chip 4) is reflected by means of an upper reflection surface 2U of a reflector 3. The reflected light L1 is emitted to a forward direction of a vehicle as a light distribution pattern LP for low beam, shown in FIG. 20.

In other words, the reflected light L1 from a first reflection surface that is made up of a fourth segment 24 of the main reflection surface 2U is controlled to be optically distributed in a range Z4 in the light distribution pattern LP for low beam. The above reflected light L1 is controlled to be optically distributed so that: reflection images I1, I2 of the light emitting chip 4 does not fly out from an oblique cutoff lines CL1 and a horizontal cutoff line CL2; and a part of the reflection images I1, I2 of the light emitting chip 4 substantially come into contact with the oblique cutoff line CL1 and the horizontal cutoff line CL2.

In addition, the reflected light L2 from a second reflection surface that is made up of a fifth segment 25 of the main reflection surface 2U is controlled to be optically distributed in a range Z5 containing the range Z4 included in the light distribution pattern LP for low beam. The above reflected light L2 is controlled to be optically distributed so that: reflection images I1, I3 of the light emitting chip 4 do not fly out from the oblique cutoff line CL1 and the horizontal cutoff line CL2; and a part of the reflection images I1, I3 of the light emitting chip 4 substantially come into contact with the oblique cutoff line CL1 and the horizontal cutoff line CL2. In addition, the above reflected light I2 is also controlled to be optically distributed so that: the density of the group of the reflection images I1, I3 of the light emitting chip 4 is lower than that of a group of the reflection images I1, I2 of the light emitting chip, the images having been formed by the first reflection surface that is made up of the fourth segment 24; and the group of the reflection images I1, I3 of the light emitting chip 4 contains that of the reflection images I1, I2 of the light emitting chip 4, the images having been formed by the first reflection surface that is made up of the fourth segment 24.

Further, the reflected light L1 from a third reflection surface that is made up of a first segment 21, a second segment 22, a third segment 23, a sixth segment 26, a seventh segment 27, and an eighth segment 28, of the main reflection surface 2U, is controlled to be optically distributed in a range Z6 containing the ranges Z4, Z5 included in the light distribution pattern LP for low beam. The above reflected light L1 is controlled to be optically distributed so that reflection images I4, I5 of the light emitting chip 4 are substantially included in the light distribution pattern LP for low beam. The above reflected light L1 is also controlled to be optically distributed so that the density of a group of the reflection images I4, I5 of the light emitting chip 4 is lower than that of the group of the reflection images I1, I2 of the light emitting chip 4, the images having been formed by the first reflection surface that is made up of the fourth segment 24, and that of the group of the reflection images I1, I3 of the light emitting chip 4, the images having been formed by the second reflection surface that is made up of the fifth segment 25. In addition, the above reflected light L1 is controlled to be optically distributed so that the group of the reflection images I4, I5 of the light emitting chip contains that of the reflection images I1, I2 of the light emitting chip, the images having been formed by the first reflection surface that is made up of the fourth segment 24, and that of the reflection images I1, I3 of the light emitting chip 4, the images having been formed by the second reflection surface that is made up of the fifth segment 25.

In the manner as described above, the light distribution pattern LP for low beam, shown in FIG. 20, is emitted to a forward direction of a vehicle.

On the other hand, as shown in FIG. 6 to FIG. 8, light L2 directly radiated to a forward direction of a vehicle from an upward light emitting surface of the light emitting chip 4 of the upper semiconductor-type light source 5U is adapted to converge and to be reflected by means of two of the first additional reflection surfaces 15U, 15U of the light shading member 12U at the second reference focal point F2, F2 side of the two of the first additional reflection surfaces 15U, 15U that are defined at both of the left and right sides with respect to the upper semiconductor light source 5U. In other words, the above radiated light L2 is adapted to converge and to be reflected at a horizontal axis X or at a site which is slightly lower than the horizontal axis X and at the front side more than a reference focal point F of the upper reflection surface 2U and the first reference focal point F1, F1 of the first additional reflection surface 15U, 15U, respectively. The reflected light L3 is adapted to converge at two of the second reference focal points F2, F2 of the first additional reflection surface 15U, 15U and radiate (scatter) from the second reference focal points F2, F2 of the two of the first additional reflection surfaces 15U, 15U. At this time, the reflected light L3 passes through two of openings 16U, 16IU between two of the first shades 13U, 13U and two of the second shades 14U, 14U. The resulting light is then reflected as an additional light distribution pattern LP1 having the cutoff lines CL1, CL2, by means of two of the second additional reflection surfaces 9, 9 that are defined at both of the left and right sides with respect to the upper semiconductor-type light source 5U.

Reflected light L4 after reflected by the two of the second additional reflection surface 9, 9 is radiated to a forward direction of a vehicle as an additional light distribution pattern LP1 having the cutoff lines CL1, CL2. The additional light distribution pattern LP1, as indicated by the light distribution pattern enclosed in the dashed line in FIG. 17, is controlled to be optically distributed in a range containing a part of the range Z4 and the range Z5 in the light distribution pattern LP for low beam. The cutoff lines CL1, CL2 of the additional light distribution pattern LP1 coincide with the cutoff line CL1, CL2 of the light distribution pattern LP for low beam.

Advantageous Effect

The vehicle headlamp 1 in the embodiment is made up of the above-described constituent elements and functions. Hereinafter, an advantageous effect of this vehicle headlamp will be described.

According to the vehicle headlamp 1 in the first embodiment, the mount portion 70U and the light shading member 12U as an optical member, i.e., the first additional reflection surfaces 15U, 15U and the first shades 13U, 13U form an integrated structure, so that the upside semiconductor-type light source 5U is mounted on the holder 6 by means of the mounting member 70U and the screw 65, whereby the upside semiconductor-type light source 5U and the light shading member 12U as an optical member, i.e., the first additional reflection surfaces 15U, 15U and the first shades 13U, 13U are mutually mounted on the holder 6 via the mount member 70U with high precision. As a result, according to the vehicle headlamp 1 in the first embodiment, a relative position between the upside semiconductor-type light source 5U and the light shading member 12U as an optical member, i.e., between the first additional reflection surfaces 15U, 15U and the first shades 13U, 13U, is determined with high precision, so that light L2 directly radiated from the light emitting chip 4 of the upside semiconductor-type light source 5U forward of a vehicle can be optically processed with high precision by means of the light shading member 12U as an optical member, i.e., the first additional reflection faces 15U, 15U and the first shades 13U, 13U.

In other words, according to the vehicle headlamp 1 in the first embodiment, the light L2 directly radiated from the light emitting chip 4 of the upside semiconductor-type light source 5U forward of the vehicle is reflected onto the side of the second additional reflection surfaces 9, 9 that are provided at the reflector 3 by means of the first additional surfaces 15U, 15U as optical members which are integrally structured with the mount member 70U, and then, the reflected light L3 can be emitted forward of the vehicle as a predetermined additional light distribution pattern LP1 by means of the second additional reflection surfaces 9, 9 of the reflector 3. In this manner, the vehicle headlamp 1 in the first embodiment is capable of effectively utilizing the light L2 directly radiated from the light emitting chip 4 of the upside semiconductor-type light source 5U forward of the vehicle, i.e., ordinarily invalid light.

Further, according to the vehicle headlamp 1 in the first embodiment, the optical members of the first additional reflection surfaces 15U, 15U are integrally structured with the mount member 70U via the light shading member 12U and are mounted on the holder 6 via the mount member 70U together with the upside semiconductor-type light source 5U, whereas the reflector 3 at which the second additional reflection surfaces 9, 9 are provided is held by means of the holder 6, so that the additional light distribution pattern LP1 can be controlled to be optically distributed with high precision by means of the first additional reflection surfaces 15U, 15U as optical members and the second additional reflection surfaces 9, 9 of the reflector 3.

Moreover, according to the vehicle headlamp 1 in the first embodiment, the mount member 70U and the light shading member 12U as an optical member, i.e., the first additional reflection surfaces 15U, 15U and the first shades 13U, 13U form an integrated structure, so that the number of parts can be reduced, and as a result, a mounting operation is simplified and manufacturing cost is reduced.

According to the vehicle headlamp 1 in the first embodiment, if the light emitting chip 4 of the upside semiconductor-type light source 5U is lit to emit light, a part of the light radiated from the light emitting chip 4 is reflected by means of the upside reflection surface 2U and then the reflected light L1 is emitted forward of a vehicle as a predetermined main light distribution pattern, i.e., a light distribution pattern LP for low beam, having cutoff lines CL1, CL2 (hereinafter, referred to as "a predetermined light distribution pattern LP for low beam").

On the other hand, according to the vehicle headlamp 1 in the first embodiment, light L2 directly radiated from the light emitting chip 4 of the upside semiconductor-type light source 5U forward of the vehicle is reflected on the horizontal axes X at both of the left and right sides relative to the upside semiconductor-type light source 5U or slightly downward of the horizontal axes X the two first additional reflection surfaces 15U, 15U at both of the left and right sides, and at the forward side more than a reference focal point F of the upside reflection surface 2U and the first reference focal points F1, F1 of the first additional reflection surfaces 15U, 15U.

The reflected light L3 is reflected by means of the two second additional reflection surfaces 9, 9 at both of the left and right sides of the upside main reflection surface 2U. The reflected light L4 is emitted forward of the vehicle as a predetermined additional light distribution pattern, i.e., the additional light distribution pattern LP1 having cutoff lines CL1, CL2 (hereinafter, referred to as "a predetermined additional light distribution pattern LP1"). In this manner, according to the vehicle headlamp 1 in the first embodiment 1, the light L2 directly radiated from the light emitting chip 4 forward of the vehicle, which is not used to form the predetermined light distribution pattern LP for low beam, is the one that is used after being formed as the predetermined additional light distribution pattern LP1 by means of the first additional reflection surfaces 15U, 15U and the second additional reflection surfaces 9, 9, and the light from the upside semiconductor-type light source 5U can be effectively utilized. Therefore, the vehicle headlamp 1 in the first embodiment is capable of downsizing a lamp unit formed by the constituent elements 3, 5U, 6, 7, 70U, 12U, 13U, 13U, 14U, 14U and reducing manufacturing cost.

According to the vehicle headlamp 1 in the first embodiment, the light shading member 12U having the two of the first additional reflection surfaces 15U, 15U is disposed in a space other than an optical path L1 which is emitted with light at least from the upper main reflection surface 2U to the forward direction of the vehicle. Therefore, the light shading member 12U having the two of the first additional reflection surfaces 15U, 15U does not interfere with the optical path L1 of the predetermined light distribution pattern LP for low beam, emitted from the upper main reflection surface 2U to the forward direction of the vehicle. As a result, the vehicle headlamp in the first embodiment can efficiently utilize almost all of the reflected light L1 from the upper main reflection surface 2U as the predetermined light distribution pattern LP for low beam without being shaded by the light shading member 12U having the two of the first additional reflection surfaces 15U, 15U. In addition, a failure such as partial lowering of light quantity (luminous intensity, intensity of illumination) in the predetermined light distribution pattern LP for low beam by means of the light shading member 12U having the two of the first additional reflection surfaces 15U, 15U is unlikely to occur. In other words, even if a part of the light shading member 12U is convex in the optical path L1 that is emitted with light from the upper main reflection surface 2U to the forward direction of the vehicle, the above-described failure is unlikely to occur. Therefore, the vehicle headlamp 1 in the first embodiment is capable of downsizing a lamp unit formed by the constituent elements assigned by reference numerals 3, 5U, 6, 7, 70U, 12U, 13U, 13U, 14U, 14U and reducing manufacturing cost.

Furthermore, according to the vehicle headlamp 1 in the first embodiment, two of the second additional reflection surfaces 9, 9 are provided at sites other than the upper main reflection surface 2U of the reflector 3 and at both of the left and right sides downward of the upper main reflection surface 2U. Therefore, a part of the upper main reflection surface 2U is not eroded by the two of the second additional reflection surface 9, 9. As a result, the vehicle headlamp 1 in the first embodiment can maintain the light quantity (luminous intensity, intensity of illumination) of the predetermined light distribution pattern LP for low beam, the pattern being formed by means of the existing upper main reflection surface 2U, whereas invalid light L2 from the light emitting chip 4 of the upper semiconductor-type light source 5U is efficiently utilized by means of two of the first additional reflection surfaces 15U, 15U and two of the second additional reflection surfaces 9, 9, respective ones of which are additionally provided. Therefore, the light quantity (luminous intensity, intensity of illumination) of the predetermined additional light distribution pattern LP1 can be efficiently utilized with respect to the light quantity (luminous intensity, intensity of illumination) of the predetermined light distribution pattern LP for low beam. Therefore, the vehicle headlamp 1 in the first embodiment is capable of downsizing a lamp unit formed by the constituent elements assigned by reference numerals 3, 5U, 6, 7, 70U, 12U, 13U, 13U, 14U, 14U and reducing manufacturing cost.

In addition, according to the vehicle headlamp 1 in the first embodiment, a predetermined light distribution pattern LP for low beam is formed by means of the upper main reflection surface 2U, whereas a predetermined additional light distribution pattern LP1 is formed by means of two shades defined at both of the left and right sides, i.e., by means of two of the first shades 13U, 13U and two of the second shades 14U, 14U. Therefore, the vehicle headlamp 1 in the first embodiment is capable of downsizing a lamp unit formed by the constituent elements assigned by reference numerals 3, 5U, 6, 7, 70U, 12U, 13U, 13U, 14U, 14U and reducing manufacturing cost. As a result, the vehicle headlamp 1 in the first embodiment can easily and reliably obtain light distribution patterns LP, LP1 having cutoff lines CL1, CL2 whose light quantity (luminous intensity, intensity of illumination) is increased, by means of the predetermined light distribution pattern LP for low beam and the predetermined light distribution pattern LP1.

Moreover, according to the vehicle headlamp 1 in the first embodiment, two of the first shades 13U, 13U that are defined at both of the left and light sides and two of the second shades 14U, 14U that are defined at both of the left and right sides are disposed in a space other than the optical path L1 that is emitted with light from the upper main reflection surface 2U to the forward direction of the vehicle and between two of the first additional reflection surfaces 15U, 15U that are defined at both of the left and right sides and two of the second additional reflection surfaces 9, 9 that are defined at both of the left and right sides. These shades are disposed so that two of the first shades 13U, 13U and two of the second shades 14U, 14U do not interfere with the main light distribution pattern that is emitted from the upper main reflection surface 2U to the forward direction of the vehicle. In other words, the above shades are disposed so as not to interfere with the optical path L1 of the light distribution pattern LP for low beam, the pattern having the cutoff lines CL1, CL2. As a result, the vehicle headlamp 1 in the first embodiment can efficiently utilize almost all of the reflected light L1 from the upper main reflection surface 2U as the predetermined light distribution pattern LP for low beam without being shaded by two of the first shades 13U, 13U and two of the second shades 14U, 14U. In addition, a failure such as partial lowering of light quantity (luminous intensity, intensity of illumination) in the predetermined light distribution pattern LP for low beam by means of two of the first shades 13U, 13U and two of the second shades 14U, 14U does not occur. Therefore, the vehicle headlamp 1 in the first embodiment is capable of downsizing a lamp unit formed by the constituent elements assigned by reference numerals 3, 5U, 6, 7, 70U, 12U, 13U, 13U, 14U, 14U and reducing manufacturing cost.

Further, according to the vehicle headlamp 1 in the first embodiment, the first additional reflection surfaces 15U, 15U are made up of two elliptical free curved faces that are defined at both of the left and right sides; the second additional reflection surfaces 9, 9 are made up of two parabolic free curved faces that are defined at both of the left and right sides; and the at least one shade is made up of two of the first shades 13U, 13U that are defined at both of the left and right sides and two of the second shades 14U, 14U that are defined at both of the left and right sides. Therefore, the light L1 directly emitted from the light emitting chip 4 of the upper semiconductor-type light source 5U can be emitted to the forward direction of the vehicle as the predetermined additional light distribution pattern LP1 by means of: two of the first additional reflection surfaces 15U, 15U; two of the second additional reflection surfaces 9, 9; two of the first shades 13U, 13U; and two of the second shades 14U, 14U. Further, the light L2 emitted from the upper semiconductor-type light source 5U can be utilized further efficiently and reliably in comparison with one of the first additional reflection surfaces and one of the second additional reflection surfaces. Therefore, the vehicle headlamp 1 in the first embodiment is capable of downsizing a lamp unit formed by the constituent elements assigned by reference numerals 3, 5U, 6, 7, 70U, 12U, 13U, 13U, 14U, 14U and reducing manufacturing cost.

Moreover, according to the vehicle headlamp 1 in the first embodiment, two of the first shades 13U, 13U and two of the second shades 14U, 14U are disposed between two of the first additional reflection surfaces 15U, 15U and two of the second additional reflection surfaces 9, 9 and at or near the second reference focal points F2, F2 of two of the first additional reference surfaces 15U, 15U. As a result, according to the vehicle headlamp 1 in the first embodiment, the reflected light L3 that converges at the second reference focal points F2, F2 of two of the first additional reflection surfaces 15U, 15U or the reflected light L3 radiated (diffused) from the second reference focal points F2, F2 of two of the first additional reflection surfaces 15U, 15U can be controlled to be optically distributed precisely, easily, and reliably as a predetermined additional light distribution pattern LP1 by means of two of the first shades 13U, 13U, two of the second shades 14U, 14U, and two openings 16U, 16U that are disposed at or near the second reference focal points F2, F2 of two of the first additional reference surfaces 15U, 15U. Therefore, the vehicle headlamp 1 in the first embodiment is capable of downsizing a lamp unit formed by the constituent elements assigned by reference numerals 3, 5U, 6, 7, 70U, 12U, 13U, 13U, 14U, 14U and reducing manufacturing cost.

In the first embodiment, two of the first additional reflection surfaces 15U, 15U are provided at the left and right of one light shading member 12U. In addition, two of the second additional reflection surfaces 9, 9 are provided at the left and right of one reflector 3. Further, two of the first shades 13U, 13U and two of the second shades 14U, 14U are provided at the left and right between the first additional reference surfaces 15U, 15U and the second additional reflection surfaces 9, 9. However, in the present invention, one of the first additional reflection surfaces, one of the second additional surfaces, and one of the shades, i.e., one of the first shades and one of the second shades may be provided at either of the left and right sides.

In addition, the first embodiment focuses on the upside lamp unit, wherein the constituent elements of the lamp unit, designated by reference numerals 3, 5U, 6, 7, 12U, 13U, 13U, 14U, 14U are provided upper than the horizontal axis X. However, in the present invention, there may be the downside lamp unit, wherein the above constituent elements of the lamp unit are provided lower than the horizontal axis.

Second Embodiment

FIG. 21 to FIG. 28 show a vehicle headlamp according to a second embodiment of the present invention. Hereinafter, the vehicle headlamp in the second embodiment will be described. In the figures, like constituent elements shown in FIG. 1 to FIG. 20 are designated by like reference numerals. Here, in light shading members; first shades; second shades; first additional reflection surfaces; and openings, the constituent elements of the upside unit are designated by reference numerals 2D, 5D, 70D, 12U, 13U, 14U, 15U, 16U and on the other hand, the constituent elements of the downside unit are designated by reference numerals 2D, 5D, 70D, 12D, 13D, 14D, 15D, 16D.

According to the vehicle headlamp 100 in the second embodiment, the constituent elements of the downside unit in which the light emitting surface of a light emitting chip 4 is oriented downward in a vertical Y-axis direction (a lower reflection surface 2D and a lower semiconductor-type light source 5D) are disposed so as to be established in a point-symmetrical state while a point O is defined as a center with respect to the constituent elements of the upside unit in which the light emitting surface of the light emitting chip 4 is oriented downward in the vertical Y-axis direction (in other words, the upper reflection surface 2U and the upper semiconductor-type light source 5U of the first embodiment). A reflection surface design of each of the segments 21 to 28 of the upper reflection surface 2U and a reflection surface design of each of the segments 21 to 28 of the lower reflection surface 2D are not in a mere point-symmetry (not in an inverted state).

In addition, two of the upper first shades 13U, 13U and two of the upper second shades 14U, 14U that are defined at both of the left and light sides; and two of the lower first shades 13D, 13D and two of the lower second shades 141), 141) at the both of the left and right sides are not in a mere point-symmetry (not in an inverted state). In other words, upper openings 16U, 16U between two of the upper first shades 13U, 13U and two of the upper second shades 14U, 14U that are defined at both of the left and right sides are moved as these constituent elements are provided in parallel from an upper side to a lower side, thereby forming lower openings 16D, 16D between two of the lower first shades 13D, 13D and two of the lower second shades 14D, 14D that are defined at both of the left and right sides. Therefore, upper edges of two of the lower openings 161), 16D, i.e., lower edges of two of the first shades 13D, 13D form a horizontal line. Lower edges of two of the lower openings 16D, 16D, i.e., upper edges of two of the lower second shades 14D, 14D form a step-difference horizon in which a right-side half is lowered by one stage with respect to a left-side half.

In FIG. 21 to FIG. 25, a horizontal axis X, a vertical axis Y, and a reference optical axis Z, as in the first embodiment, constitute an orthogonal coordinate (an X-Y-Z orthogonal coordinate system) while a center O1 of a light emitting chip 4 is defined as an origin. The horizontal axis X, the vertical axis Y, and the reference optical axis Z, are as in the first embodiment in the case of the constituent elements of the upside unit, designated by reference numerals 2U, 5U, 12U, 13U, 13U, 14U, 14U. In the case of the constituent elements of the downside unit, designated by reference numerals 2D, 5D, 12D, 13D, 13D, 14D, 14D in the horizontal axis X, the left side corresponds to a positive direction and the right side corresponds to a negative direction. In the vertical axis Y, the lower side corresponds to a positive direction and the upper side corresponds to a negative direction. In the reference optical axis, the front side corresponds to a positive direction and the rear side corresponds to a negative direction.

Like the vehicle headlamp 1 of the first embodiment described previously, the vehicle headlamp 100 in the second embodiment is comprised of: a reflector 300 having an upside main reflection surface 2U and a downside main reflection surface 2D as reflection surfaces which are made of parabola-based free curved faces (NURBS-curved faces) and second additional reflection surfaces 9, 9 as additional reflection surfaces which are made of parabola-based free curved faces; an upside semiconductor-type light source 5U and a downside semiconductor-type light source 5D as semiconductor-type light sources having light emitting chips 4 which are formed in a planar rectangle shape (a planer elongated shape); a holder 6 as a holding member; a heat sink member 7; an upside mount member 70U and a downside mount member 70D; a light shading member 12U having first additional reflection surfaces 15U, 15U as additional reflection surfaces which are made of elliptical free curved faces as upside optical members; two shades 13U, 13U, 14U, 14U as the upside optical members, similarly; a light shading member 12D having first additional reflection surfaces 15D, 15D as additional reflection surfaces which are made of elliptical free curved faces as downside optical members; two shades 13D, 13D, 14D, 14D as downside optical members, similarly; and a lamp housing and a lamp lens (such as a transparent outer lens, for example), although not shown.

In an upside unit, the mount member 70U, the light shading member 12U as an optical member, i.e., the first additional reflection surfaces 15U, 15U and the two first shades 13U, 13U as optical members form an integrated structure. In addition, the reflector 300 and the two second shades 14U, 14U form an integrated structure. On the other hand, in a downside unit, the mount member 70D and the light shading member 12D as an optical member, i.e., the first additional reflection surfaces 15D, 15D and the two first shades 13D, 13D as optical members form an integrated structure. In addition, the reflector 300 and the two second shades 14D, 14D form an integrated structure.

The reflector 300 and the two second shades 14U, 14U, 14D, 14D that are integrally structured therewith are fixedly held on the holder 6. The upside semiconductor-type light source 5U and the downside semiconductor-type light source 5D are mounted on the holder 6 by means of the mount member 70U and the mount member 70D. The light shading member 12U as an optical member of the upside unit, i.e., the first additional reflection surfaces 15U, 15U and the two first shades 13U, 13U are mounted on the holder 6 by means of the mount member 70U that is integrally structured therewith. On the other hand, the light shading member 12D as an optical member of the downside unit, i.e., the first additional reflection surfaces 15D, 15D and the two first shades 13D, 13D are mounted on the holder 6 by means of the mount member 70D that is integrally structured therewith. In addition, the holder 6 is mounted on the heat sink member 7.

The reflector 300, the upside semiconductor-type light source 5U, the downside semiconductor-type light source 5D, the holder 6, the heat sink member 7, the mount members 70U, 70D, the light shading members 12U, 12D, and the two shades 13U, 13U, 14U, 14U, 13D, 13D, 14D, 14D form a lamp unit. The lamp unit formed by the constituent elements assigned by reference numerals 300, 5U, 5D, 6, 7, 70U, 70D, 12U, 13U, 13U, 13D, 13D, 14U, 14U, 14D, 14D is disposed in a lamp room partitioned by the lamp housing and the lamp lens via an optical axis adjustment mechanism, for example. In the lamp room, there may be disposed another lamp unit such as a fog lamp, a cornering lamp, a clearance lamp, or turn signal lamp other than the lamp unit formed by the constituent elements assigned by reference numerals 300, 5U, 5D, 6, 7, 70U, 70D, 12U, 13U, 13U, 13D, 13D, 14U, 14U, 14D, 14D.

A reflector 300 is made up of an optically opaque resin member, for example. The reflector 300 forms the shape of a substantially rotational parabolic face while an axis passing through a center point O is defined as a rotary axis. A front side of the reflector 300 is opened in a substantially circular shape. The size of a substantially circular opening at the front side of the reflector 300 is equal to or smaller than about 100 mm in diameter. On the other hand, a rear side of the reflector 300 is closed. The window portion 8 that is formed in a substantially transversely elongated rectangle is provided at an intermediate part of the closed portion of the reflector 300. The holder 6 is inserted into the window portion 8 of the reflector 300.

Among the inside (front-side) faces of the closed portion of the reflector 300, the upper main reflection surface 2U is provided on an upper face of the window portion 8. The upper main reflection surface 2U made up of a parabolic free curved face (a NURBS curved face) has a reference focal point (a pseudo focal point) F and a reference optical axis (a pseudo optical axis) Z. Among the inside (front-side) faces of the closed portion of the reflector 300, faces that are defined at both of the left and right sides of the window portion 8 and that are defined at the lower portion of the upper main reflection surface 2U are non-luminous faces which the light radiated from the light emitting surface of the light emitting chip 4 of the lower semiconductor-type light source 5D does not reach, i.e., non-luminous faces 9, 9.

Among the inside (front-side) faces of the closed portion of the reflector 300, the upper main reflection surface 2U is provided on an upper face of the window portion 8. The upper main reflection surface 2U made up of a parabolic free curved face (a NURBS curved face) has a reference focal point (a pseudo focal point) F and a reference optical axis (a pseudo optical axis) Z. Among the inside (front-side) faces of the closed portion of the reflector 300, faces that are defined at both of the left and right sides of the window portion 8 and that are defined at the upper portion of the lower main reflection surface 2D are non-luminous faces which the light radiated from the light emitting surface of the light emitting chip 4 of the lower semiconductor-type light source 5D does not reach, i.e., non-luminous faces 9, 9.

In addition, the vehicle headlamp 100 in the second embodiment provides the constituent elements of the upside unit, i.e., one light shading member 12U; two of the first shades 13U, 13U that are defined at both of the left and right sides; two of the second shades 14U, 14U that are defined at both of the left and right sides; two of the first additional reflection surfaces 15U, 15U that are defined at both of the left and right sides; and two of the openings 16U, 16U that are defined at both of the left and right sides, as is the case with the constituent elements of the upside unit of the first embodiment, i.e., one light shading member 12D; two of the first shades 13D, 13D that are defined at both of the left and right sides; two of the second shades 14D, 14D that are defined at both of the left and right sides; two of the first additional reflection surfaces 15D, 15D that are defined at both of the left and right sides; and two of the openings 16D, 16D that are defined at both of the left and right sides.

In other words, the constituent elements of the downside unit, i.e., the light shading member 12D, the first shades 13D, 13D, the second shades 14D, 14D, the first additional reflection surfaces 15D, 15D, and the openings 16D, 16D are disposed so as to be established in a point-symmetrical state while the point O is defined as a center with respect to the constituent elements of the upside unit, i.e., the light shading member 12U, the first shades 13U, 13U, the second shades 14U, 14U, the first additional reflection surface 15U, 15U, and the openings 16U, 16U.

The first reference focal points F1, F1 of two of the first additional reflection surfaces 15D, 15D of the downside unit are positioned at or near the reference focal point F of the lower main reflection surface 2D and is shared or substantially shared. In addition, the second reference focal points F2, F2 of two of the first additional reflection surfaces 15D, 15D of the downside unit are positioned at the horizontal axis X or in upward proximity of the horizontal axis X. These focal points are also positioned at both of the left and right sides with respect to the lower semiconductor-type light source 5D. Moreover, the above focal points are positioned at the front side more than the reference focal point F of the lower main reflection surface 2D or the first reference focal points F1, F1.

One upper light shading member 12U, two of the upper first shades 13U, 13U, and two of the upper second shades 14U, 14U are arranged respectively separately, these constituent elements are disposed in a space other than an optical path L1 which is emitted with light from the upper reflection surface 2U to a forward direction of a vehicle. Similarly, one lower light shading member 12D, two of the lower first shades 13D, 13D, and two of the lower second shades 14D, 14D are arranged in a space other than the optical path L1 which is emitted with light from the lower main reflection surface 2D to the forward direction of the vehicle.

Figure 26:
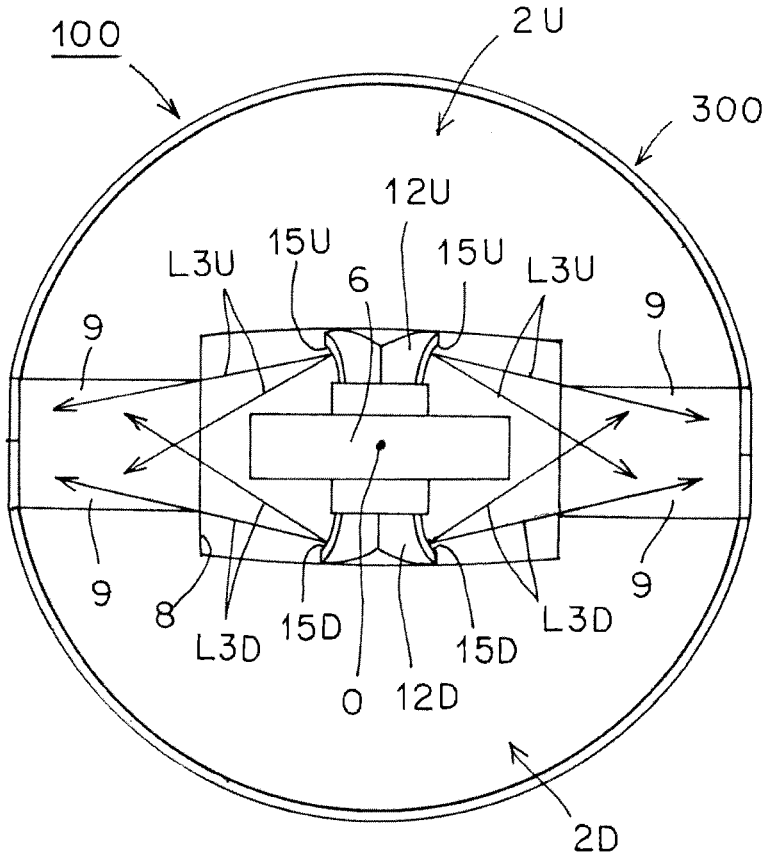
FIG. 26 is an explanatory view showing an optical path of reflection light to be reflected from the first additional reflection surface to a second reflection surface, similarly.

Two of the second additional reflection surfaces 9, 9 that are defined at both of the left and light sides of the upside unit; and two of the second additional reflection surfaces 9, 9 that are defined at both of the left and right sides of the downside unit, are common as shown in FIG. 26 in the embodiment. These reflection surfaces are disposed between the main reflection surface 2U of the upside unit and the main reflection surface 2D of the downside unit. As a result, reflected light L3U from the upper first additional reflection surfaces 15U, 15U and reflected light L3D from the lower first additional reflection surfaces 15D, 15D are incident to two of the second additional reflection surfaces 9, 9 that are defined at both of the left and right sides of the upside unit and two of the second additional reflection surfaces 9, 9 that are defined at both of the left and right sides of the downside unit, respective ones of which are common. Further, the incident light is radiated to the forward direction of the vehicle as a predetermined additional light distribution pattern.

Figure 27:
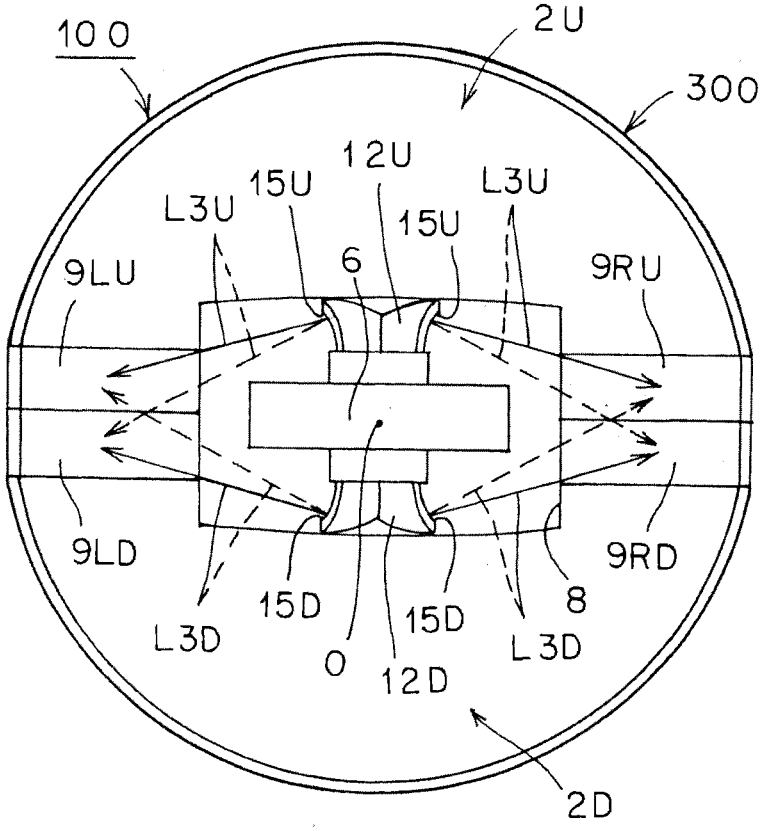
FIG. 27 is an explanatory view showing a first modified example of the optical path of the reflection light to be reflected from the first additional reflection surface to the second additional reflection surface.

There are several cases in which two of the second additional reflection surfaces 9, 9 that are defined at both of the left and right of the upside unit; and two of the second additional reflection surfaces 9, 9 that are defined at both of the left and right sides of the downside unit, are shared at both of the upper and lower sides, respectively, as shown in FIG. 27, for example. In other words, there are several cases in which the second additional surface that is defined at the left side is shared with an upper portion 9LU and a lower portion 9LD; and the second additional reflection surface that is defined at the right side is shared with an upper portion 9RU and a lower portion 9RD.

For example, one case is that in which there are arranged: second additional reflection surfaces 9LU, 9RU that are defined at the upper left and right, for the sake of incidence of reflected light L3U (the reflected light L3U that is indicated by the solid line) from the first additional reflection surfaces 15U, 15U of the upside unit; and second additional reflection surfaces 9LD, 9RD that are defined at the lower left and right for the sake of incidence of reflected light L3D (the reflected light L3D that is indicated by the solid line) from the first additional reflection surfaces 15D, 15D of the downside unit. In addition, another case is that in which there are arranged: second additional reflection surfaces 9LD, 9RD that are defined at the lower left and right for incidence of reflected light L3D (the reflected light L3D indicate by the solid line) from the first additional reflection surfaces 15D, 15D of the downside unit; and second additional reflection surfaces 9LU, 9RU that are defined at the upper left and right, for the sake of incidence of reflected light L3D (the reflected light that is indicated by the dashed line); and second additional reflection surfaces 9LU, 9RU that are defined at the upper left and right for the sake of incidence of reflected light L3D (the reflected light L3D that is indicated by the dashed line). Further, still another case is that in which there are arranged: a second additional reflection surface 9LU that is defined at the upper left and a second additional reflection surface 9RD that is defined at the lower right, for the sake of incidence of the reflected light L3U (the left side corresponds to the reflected light L3U that is indicated by the solid line and the right side corresponds to the reflected light L3U that is indicated by the dashed line) from the first additional reflection surfaces 15U, 15U of the upside unit; and a second additional reflection surface 9LD that is defined at the lower left and a second additional reflection surface 9RU that is defined at the upper right, for the sake of incidence of reflected light L3D (the left side corresponds to the reflected light L3D that is indicated by the solid line and the right side corresponds to the reflected light L3D that is indicated by the dashed line) from the first additional reflection surfaces 15D, 15D of the downside unit and reflected light L3D (the left side corresponds to the reflected light L3D that is indicated by the solid line and the right side corresponds to the reflected light that is indicated by the dashed line) from the first additional reflection surfaces 15D, 15D of the downside unit. Still furthermore, yet another case is that in which there are arranged: a second additional reflection surface 9LD that is defined at the lower left and a second additional reflection surface 9RU that is defined at the upper right, for the sake of incidence of reflected light L3U (the left side corresponds to the reflected light that is indicated by the dashed line and the right side corresponds to the reflected light L3U that is indicated by the solid line) from the first additional reflection surfaces 15U, 15U of the upside unit; and a second additional reflection surface 9LU that is defined at the upper left and a second additional reflection surface 9RD that is defined at the lower right, for the sake of incidence of reflected light L3D (the left side corresponds to the reflected light L3D that is indicated by the dashed line and the right side corresponds to the reflected light that is indicated by the solid line) from the first additional reflection surfaces 15D, 15D of the downside unit.

Figure 28:
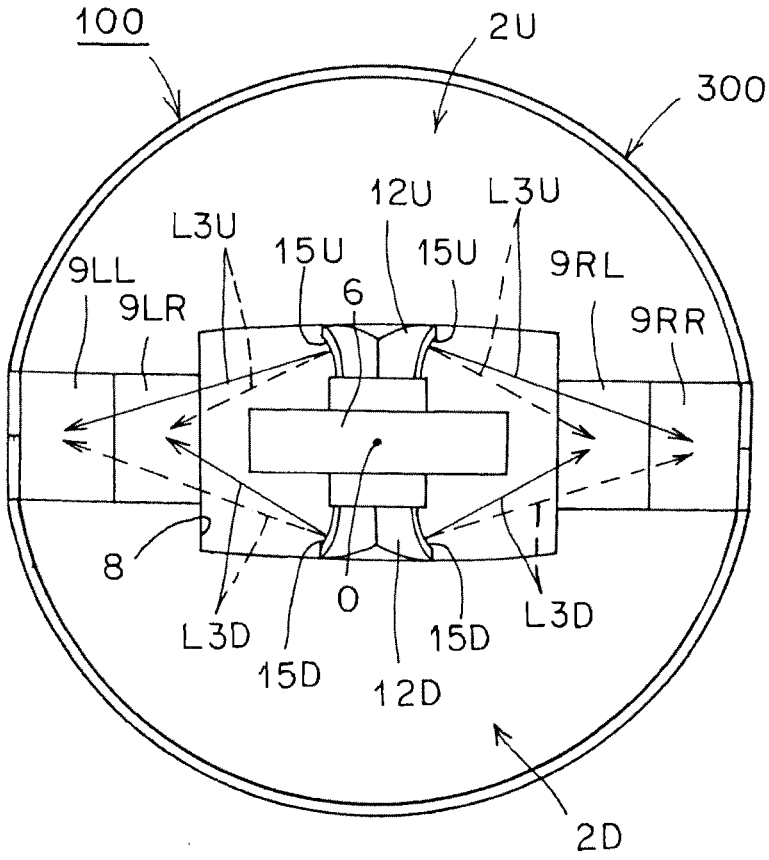
FIG. 28 is an explanatory view showing a second modified example of the optical path of the reflection light to be reflected from the first additional reflection surface to the second additional reflection surface, similarly.

In addition, there are several cases in which two of the second additional reflection surfaces 9, 9 that are defined at both of the left and right sides of the upside unit; and two of the second additional surfaces 9, 9 that are defined at both of the left and right sides of the downside unit, may be shared respectively at both of the left and right sides, as shown in FIG. 28, for example. In other words, there are several cases in which the second additional reflection surface that is defined at the left side may be shared with a portion 9LL at the left side and a portion 9LR that is defined at the right side and a second additional reflection surface that is defined at the left side may be shared with a portion 9RL that is defined at the left side and a portion 9RR that is defined at the right side in any of the following cases.

For example, one case is that in which there are arranged: a second additional reflection surface 9LL that is defined at the left-left side and a second additional reflection surface 9RR that is defined at the right-right side, for the sake of incidence of reflected light L3U (the reflected light L3U that is indicated by the solid line) from the first additional reflection surfaces 15U, 15U of the upside unit; and a second additional reflection surface 9LR that is defined at the left-right side and a second additional reflection surface 9RL that is defined at the right-left side, for the sake of incidence of reflected light L3D (the reflected light L3D that is indicated by the solid line) from the first additional reflection surface 15D, 15D of the downside unit. In addition, another case is that in which there are arranged: a second additional reflection surface 9LR that is defined at the left-right side and a second additional reflection surface 9RL that is defined at the right-left side, for the sake of incidence of reflected light L3U (the reflected light L3U that is indicated by the dashed line) from the first additional reflection surfaces 15U, 15U of the upside unit; and a second additional reflection surface 9LL that is defined at the left-left side and a second additional reflection surface 9RR that is defined at the right-right sides, for the sake of incidence of reflected light L3U (the left side corresponds to the reflected light L3U that is indicated by the solid line and the right side corresponds to the reflected light L3U that is indicated by the dashed line) from the first additional reflection surfaces 15U, 15U of the upside unit; and a second additional reflection surface 9LR that is defined at the left-right side and a second additional reflection surface 9RR that is defined at the right-right side, for the sake of incidence of reflected light L3D (the left side corresponds to the reflected light L3D that is indicated by the solid line and the right side corresponds to the reflected light L3D that is indicated by the dashed line) from the first additional reflection surfaces 15D, 15D of the downside unit. Further, still another case is that in which there are arranged: a second additional reflection surface 9LL that is defined at the left-left side and a second additional reflection surface 9RL that is defined at the right-left side, for the sake of incidence of reflected light L3U (the left side corresponds to the reflected light L3U that is indicated by the solid line and the right side corresponds to the reflected light L3U that is indicated by the dashed line) from the first additional reflection surfaces 15D, 15D of the downside unit. Furthermore, yet another case is that in which there are arranged: a second additional reflection surface 9LR that is defined at the left-right side and a second additional reflection surface 9RR that is defined at the right-right side, for the sake of incidence of reflected light L3U (the left side corresponds to the reflected light L2U that is indicated by the dashed line and the right side corresponds to the reflected light L3U that is indicated by the solid line) from the first additional reflection surfaces 15U, 15U of the upside unit; and a second additional reflection surface 9LL that is defined at the left-left side and a second additional reflection surface 9RL that is defined at the right-left side, for the sake of incidence of reflected light L3D (the left side corresponds to the reflected light L3D that is indicated by the dashed line and the right side corresponds to the reflected light L3D that is indicated by the solid line) from the first additional reflection surfaces 15D, 15D of the downside unit.

The vehicle headlamp 100 in the second embodiment is made up of the constituent elements as described above, so that the headlamp can achieve the functions and advantageous effects that are substantially similar to those of the vehicle headlamp 1 in the first embodiment.

In particular, according to the vehicle headlamp 100 in the second embodiment, in the main reflection surfaces 2U, 2D; the semiconductor-type light sources 5U, 5D; the light shading members 12U, 12D; the first additional reflection surfaces 15U, 15U, 15D, 15D; the second additional reflection surfaces 9, 9; the first shades 13U, 13U, 13D, 13D; the second shades 14U, 14U, 14D, 14D; and openings 16U, 16U, 16D, 16D, the constituent elements of the upside unit in which a light emitting surface of the light emitting chip 4 is oriented upward in the vertical Y-axis direction (in other words, the upper reflection surfaces 2U and the upper semiconductor-type light source 5U of the first embodiment) and the constituent elements of the downside unit in which the light emitting surface of the light emitting chip 4 is oriented downward in the vertical Y-axis direction (in other words, the lower reflection surface 2D and the lower semiconductor-type light source 5D) are disposed so as to be established in a point-symmetrical state while a point O is defined as a center. As a result, according to the vehicle headlamp 100 in the second embodiment, even if a reflector 300 is reduced in size, the light quantity (luminous intensity, intensity of illumination) of a predetermined light distribution pattern LP for low beam and a predetermined additional light distribution pattern LP1 can be sufficiently obtained, so that optically distributing and controlling a predetermined light distribution pattern LP for low beam and a predetermined additional light distribution pattern LP1 that are suitable for use in vehicle can be compatible with downsizing a lamp unit. Therefore, the vehicle headlamp 100 in the second embodiment is capable of downsizing the lamp unit formed by the constituent elements assigned by reference numerals 3, 5U, 5D, 6, 7, 12U, 12D, 13U, 13U, 14U, 14U, 13D, 13D, 14D, 14D and reducing manufacturing cost.

In addition, according to the vehicle headlamp 100 in the second embodiment, the second additional reflection surfaces 9, 9 of the upside unit and the second additional reflection surfaces 9, 9 of the downside unit are disposed between the main reflection surface 2U of the upside unit and the main reflection surface 2D of the downside unit. As a result, the vehicle headlamp 100 in the second embodiment entirely illuminates: the second additional reflection surfaces 9, 9 of the upside unit, which are positioned partway, and the second additional reflection surfaces 9, 9 of the downside unit; the main reflection surface 2U of the upside unit positioned at the upper side; and the main reflection surface 2D of the downside unit positioned at the lower side. Therefore, the vehicle headlamp 100 in the second embodiment is capable of downsizing the lamp unit formed by the constituent elements assigned by reference numerals 3, 5U, 5D, 6, 7, 12U, 12D, 13U, 13U, 14U, 14U, 13D, 13D, 14D, 14D and reducing manufacturing cost. Thus, according to the vehicle headlamp 100 in the second embodiment, visibility or quality is improved because a non-luminous portion is not formed between the main reflection surface 2U of the upside unit and the main reflection surface 2D of the downside unit.

In the second embodiment, two of the first upper and lower additional reflection surfaces 15U, 15U, 15D, 15D are provided at the left and right of one of the light shading members 12U, 12D. In addition, two of the upper and lower second additional reflection surfaces 9, 9 are provided at the left and right of one reflector 300. Further, the upper and lower shades, i.e., two of the upper and lower first shades 13U, 13U, 13D, 13D and two of the second upper and lower additional reflection surfaces 14U, 14U, 14D, 14D are provided at the left and right between the upper and lower first additional reflection surfaces 15U, 15U, 15D, 15D and the upper and lower second additional reflection surfaces 9, 9, 9, 9. However, in the present invention, a first additional reflection surface, a second additional reflection surface, and shades, i.e., a first shade and a second shade may be provided at only the left side or only at the right side on a one-by-one piece basis.

Third Embodiment

Figure 29:
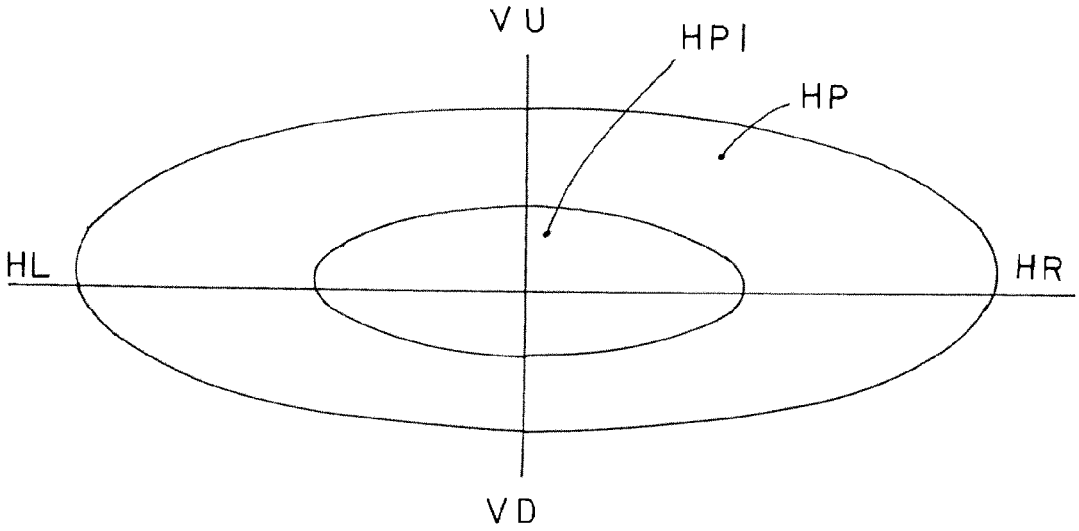
FIG. 29 is an explanatory view showing a light distribution pattern for high beam, showing a vehicle headlamp according to a third embodiment of the present invention.
Figure 30:
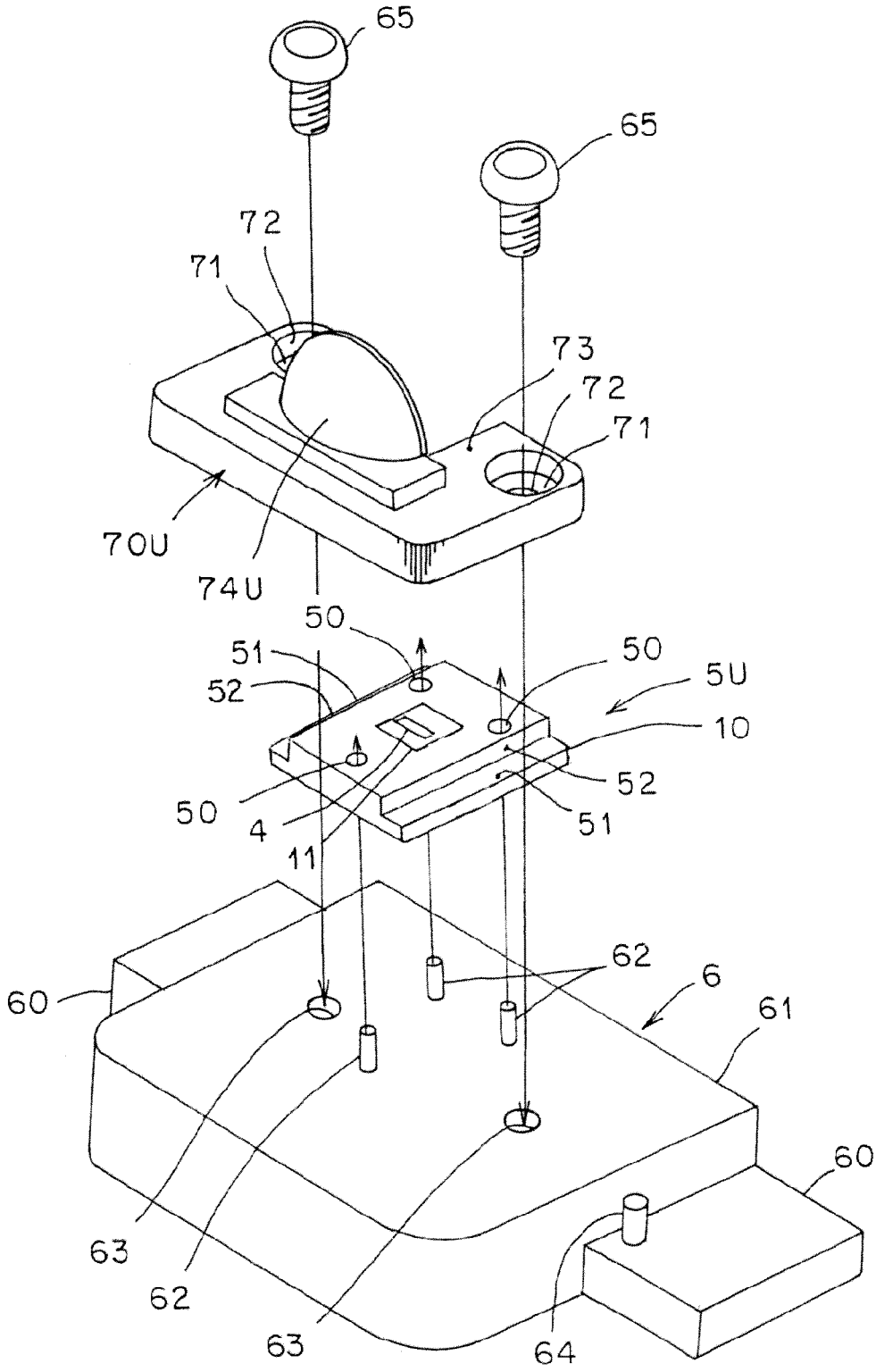
FIG. 30 is an exploded perspective view of the essential portions (the semiconductor-type light source, the holding member, the mount member, the optical member) showing a vehicle headlamp according to a fourth embodiment of the present invention.
Figure 31:
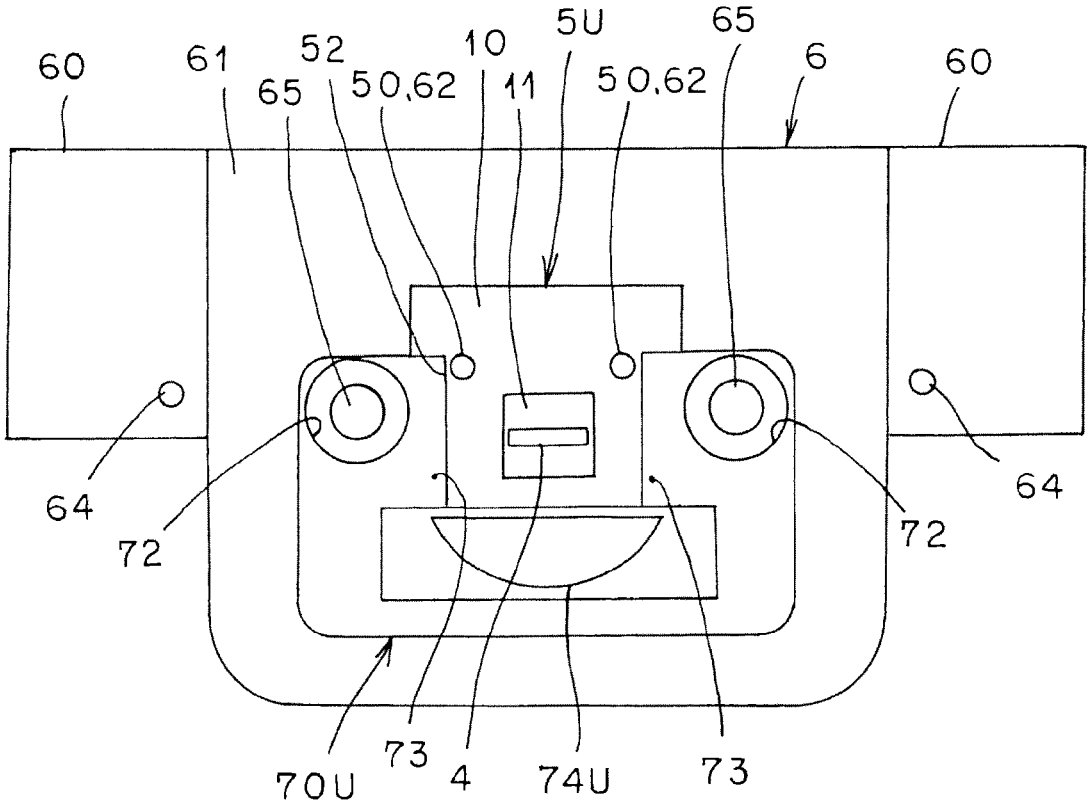
FIG. 31 is a plan view showing mounting state of the essential portions (the semiconductor-type light source, the holding member, the mount member, the optical member), similarly.
Figure 32:
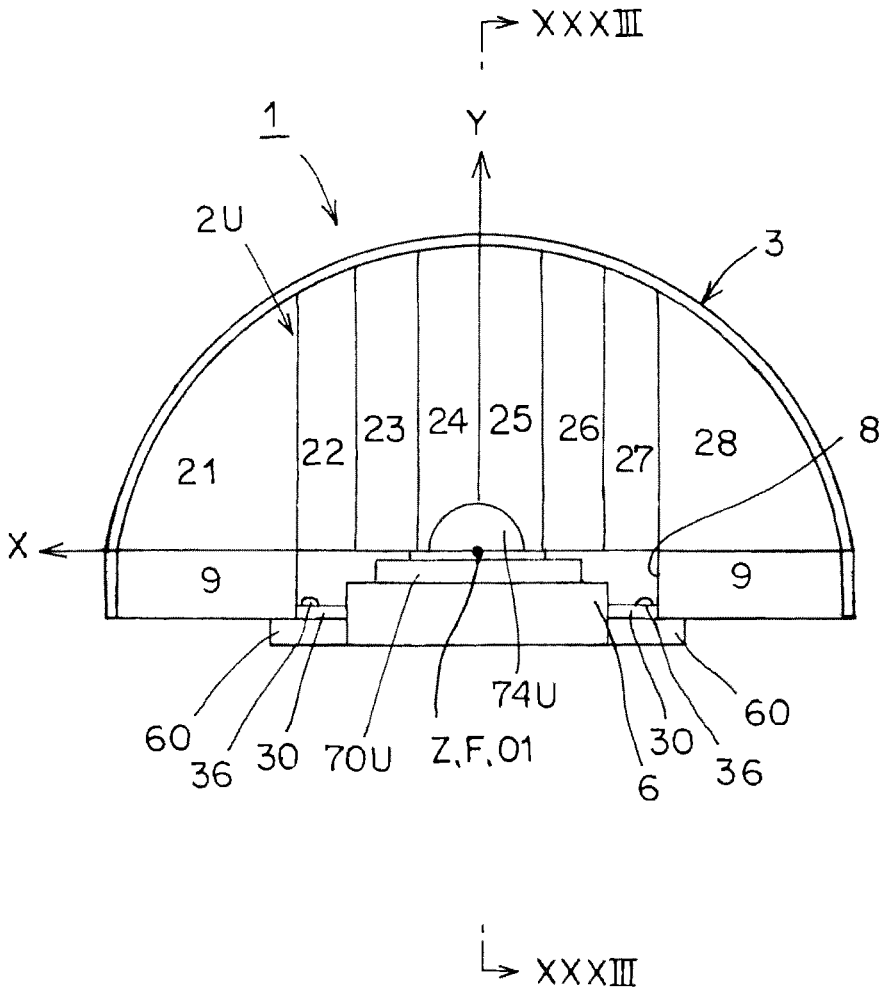
FIG. 32 is a front view showing the essential portions (the semiconductor-type light source, the reflector, the holding member, the mount member, the optical member), similarly.
Figure 33:
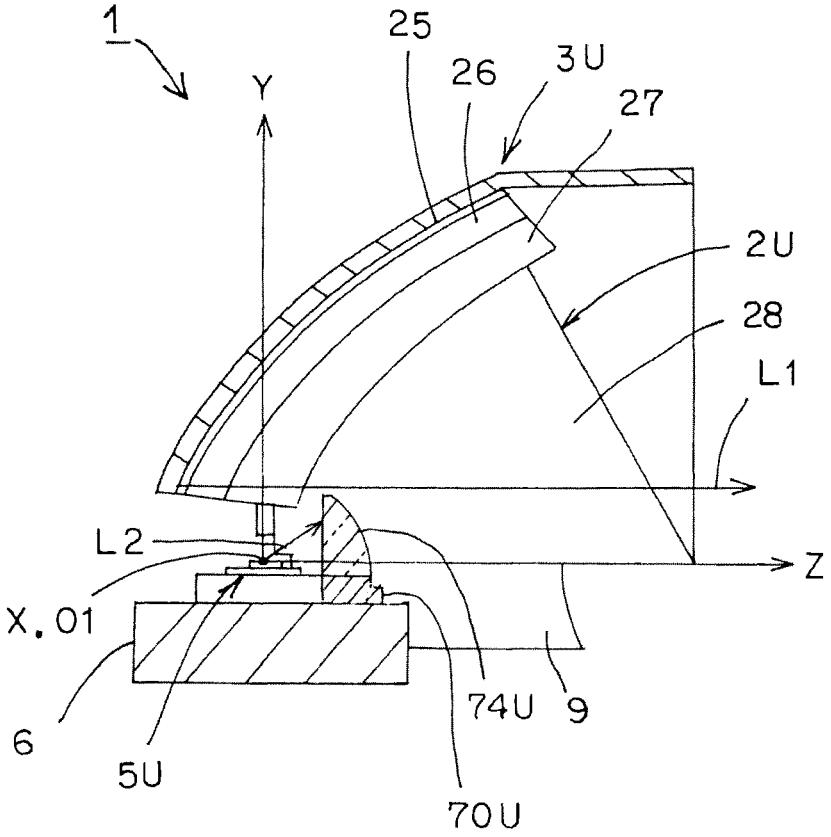
FIG. 33 is a sectional view of the essential portions, taken along the line XXXIII-XXXIII in FIG. 32, similarly.
Figure 34:
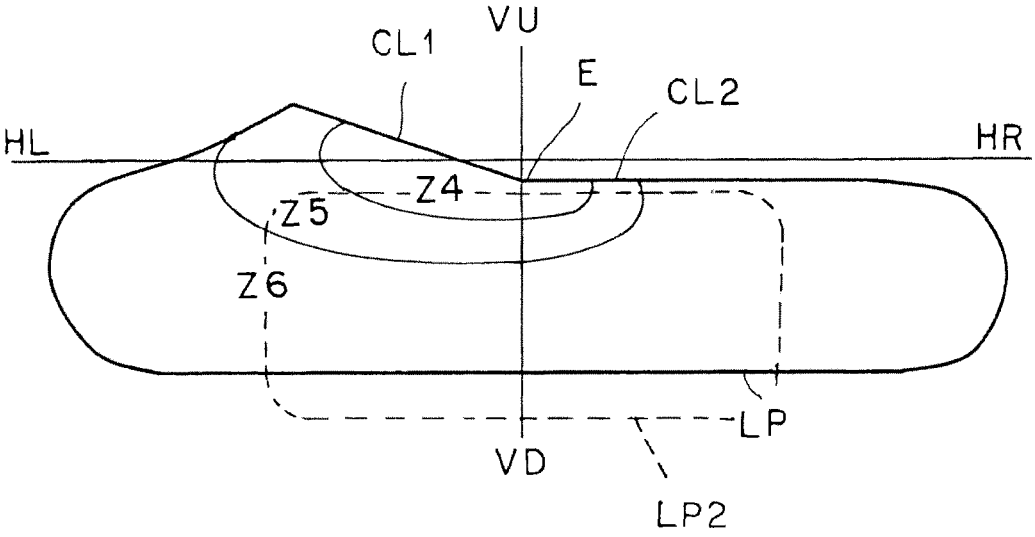
FIG. 34 is an explanatory view showing a light distribution pattern for low beam, the pattern having an oblique cutoff line and a horizontal cutoff line, similarly.
Figure 35:
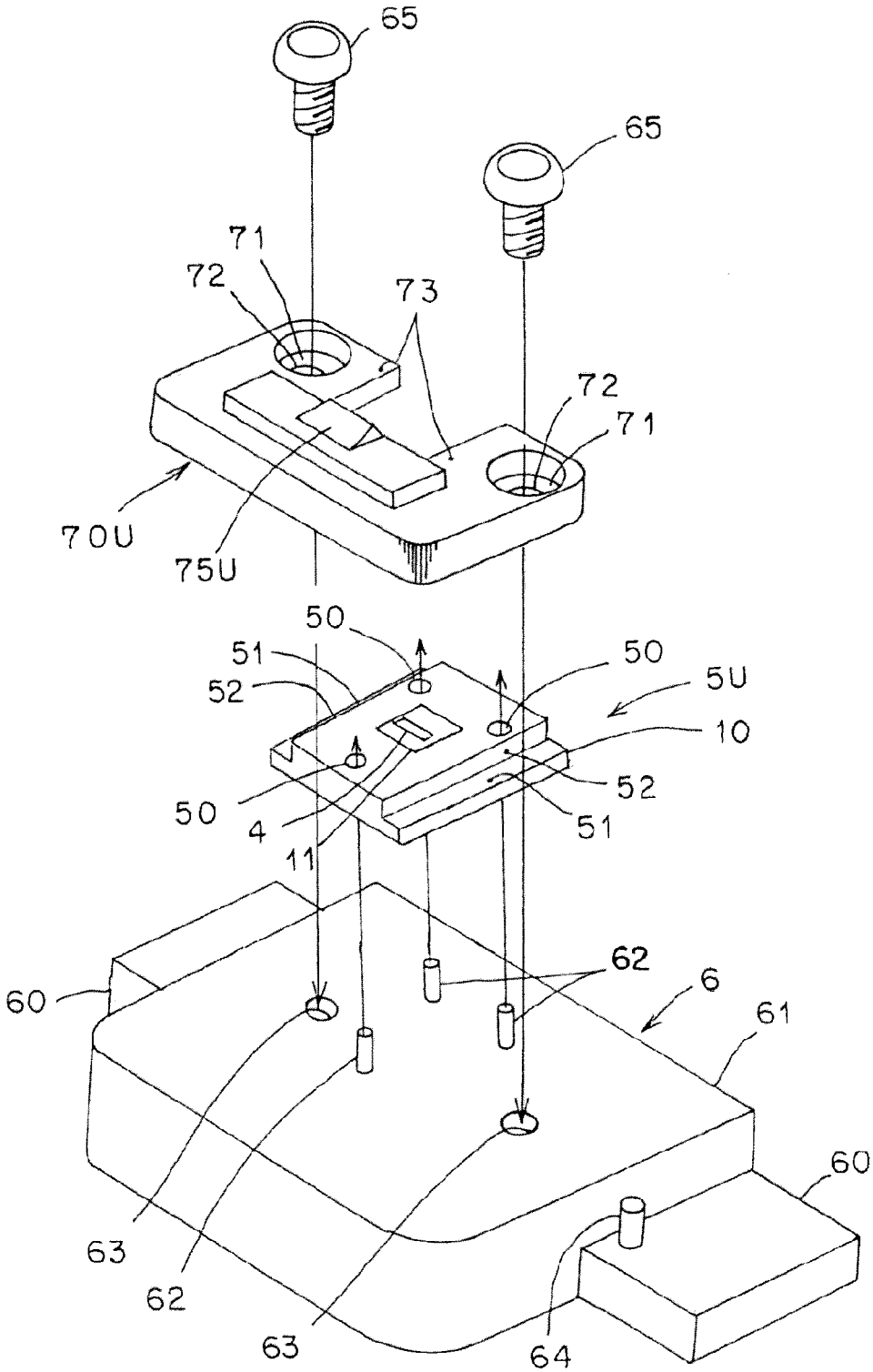
FIG. 35 is an exploded perspective view of the essential portions (the semiconductor-type light source, the holding member, the mount member, the optical member) showing a vehicle headlamp according to a fifth embodiment of the present invention.
Figure 36:
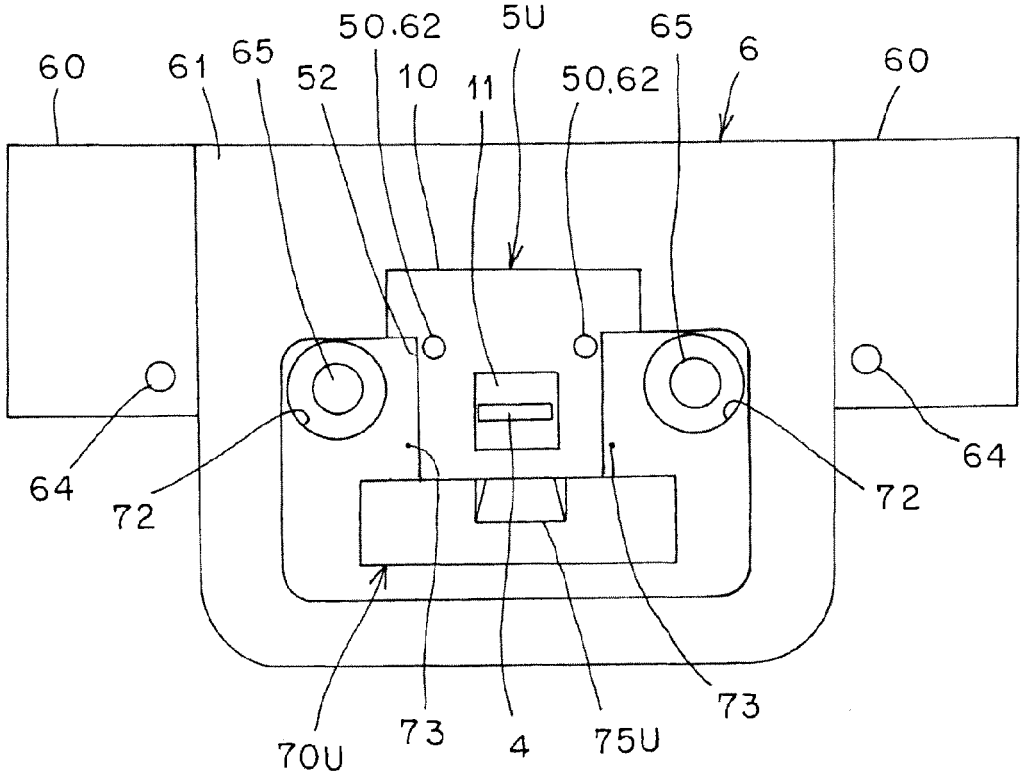
FIG. 36 is a plan view showing mounting state of the essential portions (the semiconductor-type light source, the holding member, the mount member, the optical member), similarly.
Figure 37:
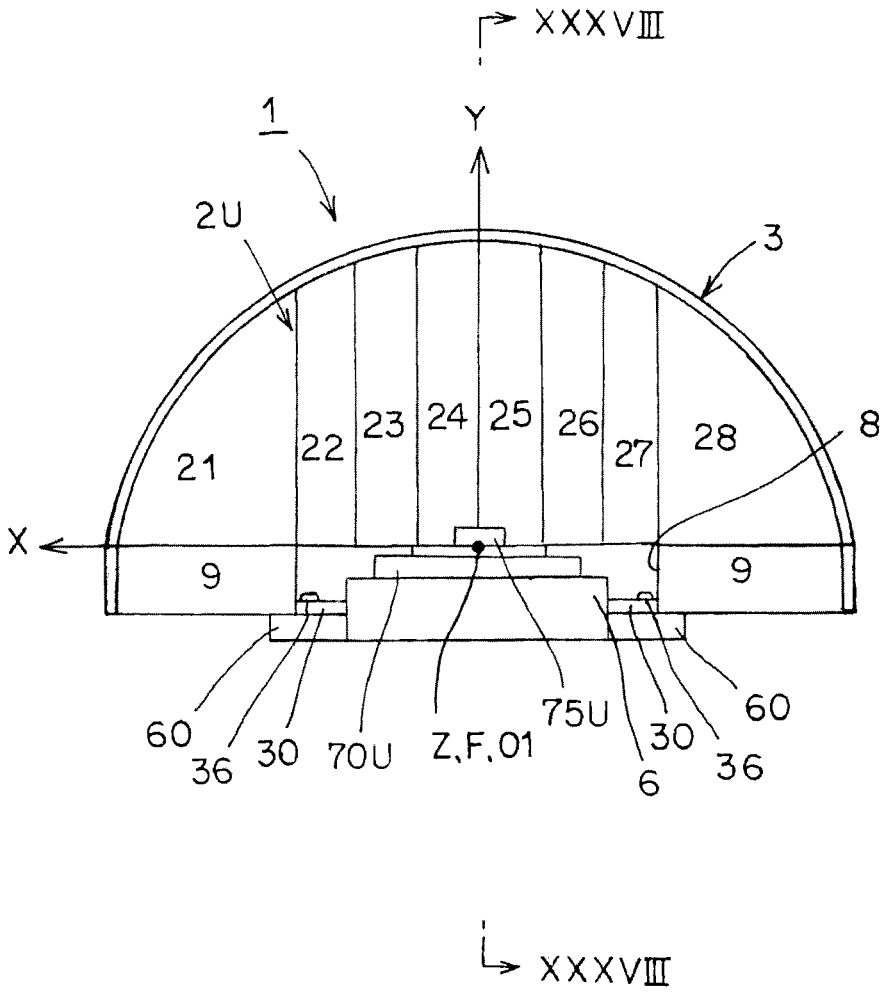
FIG. 37 is a front view showing the essential portions (the semiconductor-type light source, the reflector, the holding member, the mount member, the optical member), similarly.
Figure 38:
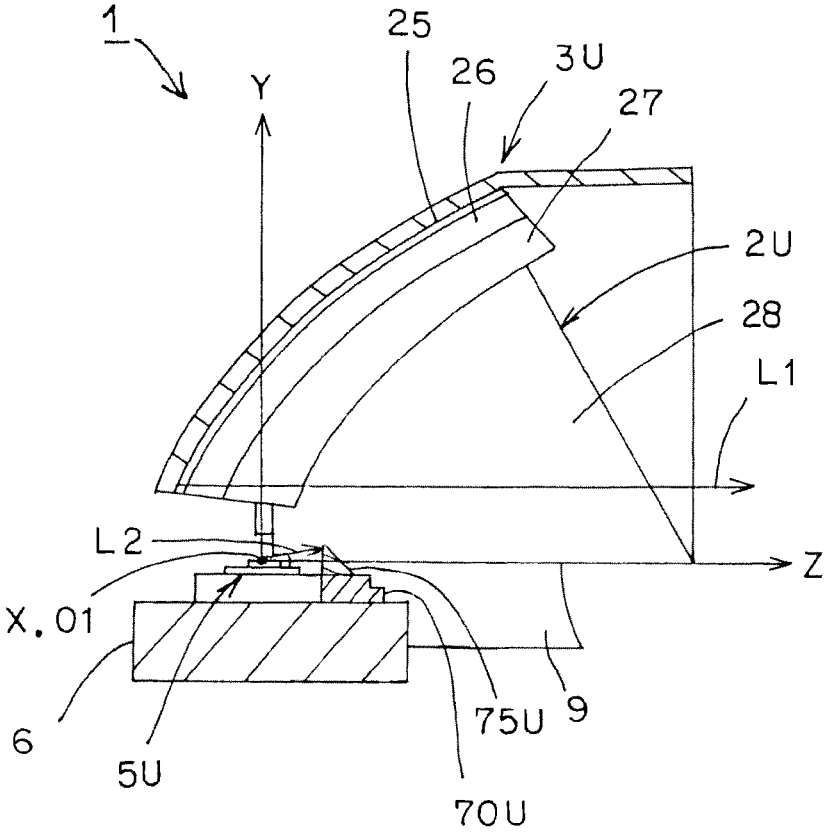
FIG. 38 is a sectional view of the essential portions, taken along the line XXXVIII-XXXVIII in FIG. 37, similarly.
Figure 39:
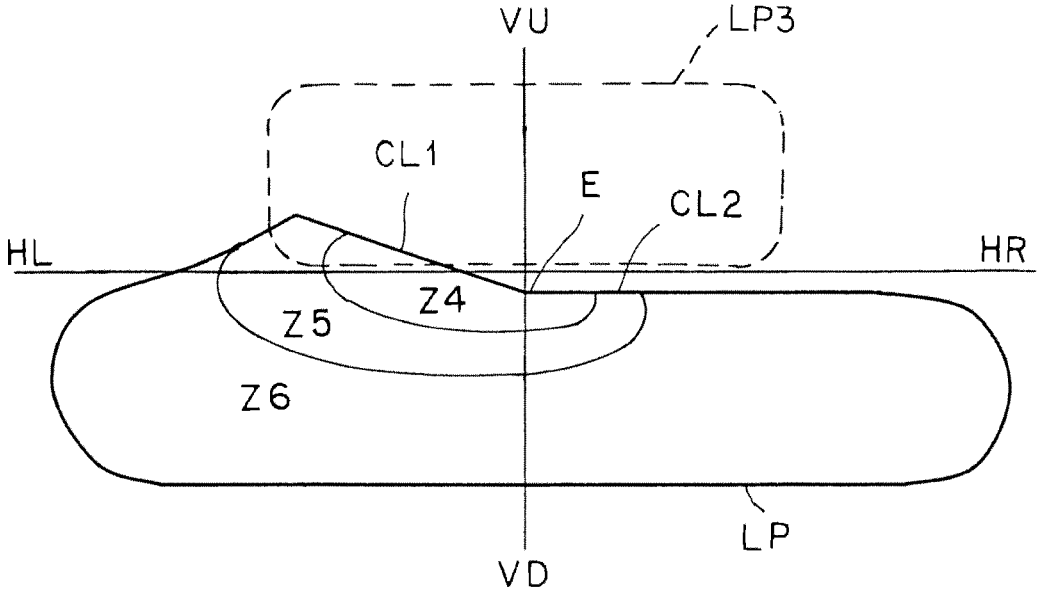
FIG. 39 is an explanatory view showing a light distribution pattern for low beam, the pattern having an oblique cutoff line and a horizontal cutoff line, similarly.

FIG. 29 shows a vehicle headlamp according to a third embodiment of the present invention. Hereinafter, the vehicle headlamp in the third embodiment will be described. In the figure, like constituent elements shown in FIG. 1 to FIG. 28 are designated by like reference numerals. The vehicle headlamp in the third embodiment emits a light distribution pattern for high beam (a light distribution pattern for running) HP as a predetermined main light distribution pattern and emits an additional light distribution pattern HP1 including a center portion of the light distribution pattern HP for high beam, as a predetermined additional light distribution pattern.

According to the vehicle headlamp in the third embodiment, the reflection surface of each of the segments 21 to 28 of main reflection surfaces 2U, 2D is defined as a reflection surface adapted to emit the light distribution pattern HP for high beam as the predetermined light distribution pattern. In addition, there is no need to use the first shades 13U, 13U, 13D, 13D and the second shades 14U, 14U, 14D, 14D, and the reflection surfaces of the first additional reflection surfaces 15U, 15U, and/or 15D, 15D and the second additional reflection surfaces 9, 9, 9, 9 are defined as reflection surfaces adapted to emit the additional light distribution pattern HP1 as the predetermined additional light distribution pattern.

The vehicle headlamp in the third embodiment is made up of the above-described constituent elements, so that the headlamp can achieve the functions and advantageous effects that are substantially similar to those of the vehicle headlamps 1, 100 in the first and second embodiments. In particular, the vehicle headlamp in the third embodiment can emit the light distribution pattern HP for high beam and the additional light distribution pattern HP1. Therefore, the vehicle headlamp in the third embodiment is capable of downsizing a lamp unit and reducing manufacturing cost.

Fourth Embodiment

FIG. 30 to FIG. 34 show a fourth embodiment of a vehicle headlamp according to the present invention. Hereinafter, the vehicle headlamp in the fourth embodiment will be described. In the figures, like constituent elements shown in FIG. 1 to FIG. 29 are designated by like reference numerals. The vehicle headlamp in the fourth embodiment is comprised of an upper unit, like the vehicle headlamp 1 of the first embodiment described previously. The headlamp in the fourth embodiment may be comprised of an upside unit and a downside unit, like the vehicle headlamp 100 of the second embodiment described previously.

According to the vehicle headlamp in the fourth embodiment, an optical member is comprised of a free curved lens 74U (see Japanese Patent Application Laid-open No. 2008-226559), whereas the optical members in the vehicle headlamp 1 of the first embodiment described previously and the vehicle headlamp 100 of the second embodiment described previously are comprised of the light shading members 12U and/or 12D having the first additional reflection surfaces 5U, 15U and/or 15D, 15D.

The free curved lens 74U is integrally provided at the mount member 70U. The mount member 70U is mounted on the holder 6, whereby the free curved lens 74U is mounted on the holder 6 together with the upside semiconductor-type light source 5U. A lens focal point (not shown) of the free curved lens 74U is positioned at or near the light emitting chip 4 of the upside semiconductor-type light source 5U.

The vehicle headlamp in the fourth embodiment is made of constituent elements as described above, and if the light emitting chip 4 of the upside semiconductor-type light source 5U is lit to emit light, a part L1 of the light radiated from an upward light emitting face of the light emitting chip 4 of the upside semiconductor-type light source 5U is emitted forward of a vehicle as a light distribution pattern LP for low beam by means of the upside main reflection surface 2U. In addition, light L2 directly radiated from the upward light emitting face of the light emitting chip 4 of the upside semiconductor-type light source 5U forward of the vehicle is emitted forward of the vehicle by means of the free curved lens 74U as a predetermined additional light distribution pattern, in this example, an additional light distribution pattern LP2 for assistance of middle area diffusion and/or proximal light (the light on the front side, i.e., the vehicle side) (the light distribution pattern at a portion surrounded by the dashed line in FIG. 34).

The vehicle headlamp in the fourth embodiment is made of the constituent elements and functions as described above, so that the light L2 directly radiated from the light emitting chip 4 of the upside semiconductor-type light source 5U forward of a vehicle can be emitted forward of the vehicle as a predetermined light distribution pattern LP2 by means of the free curved lens 74U as an optical member integrally structured with the mount member 70U. In this manner, the vehicle headlamp in the fourth embodiment is capable of effectively utilizing the light L2 directly radiated from the light emitting chip 4 of the upside semiconductor-type light source 5U forward of the vehicle, i.e., ordinarily invalid light L2.

Further, according to the vehicle headlamp in the fourth embodiment, the optical member of the free curved lens 74U is integrally structured with the mount member 70U and is mounted on the holder 6 together with the upside semiconductor-type light source 5U via the mount member 70U, so that the additional light distribution pattern LP2 can be controlled to be optically distributed with high precision by means of the free curved lens 74U as an optical member.

Fifth Embodiment

FIG. 35 to FIG. 39 show a fifth embodiment of a vehicle headlamp according to the present invention. Hereinafter, the vehicle headlamp in the fifth embodiment will be described. In the figures, like constituent elements shown in FIG. 1 to FIG. 34 are designated by like reference numerals. The vehicle headlamp in the fifth embodiment is comprised of an upside unit like the vehicle headlamp 1 of the first embodiment described previously. The vehicle headlamp in the fifth embodiment may be comprised of an upside unit and a downside unit like the vehicle headlamp 100 of the second embodiment described previously.

According to the vehicle headlamp in the fifth embodiment, an optical member is comprised of a shade 75U, whereas the optical members in the vehicle headlamp 1 of the first embodiment described previously and in the vehicle headlamp 100 of the second embodiment described previously are comprised of the light shading members 12U and/or 12D having the first additional reflection surfaces 15U, 15U and/or 15D, 15D and the optical member in the vehicle headlamp of the fourth embodiment described previously is comprised of the free curved lens 74U.

The shade 75U is integrally provided at the mount member 70U. The mount member 70U is mounted on the holder 6, whereby the shade 75U is mounted on the holder 6 together with the upside semiconductor-type light source 5U. The shade 75U is the one that shades light L2 directly radiated forward of a vehicle without being incident to the upside main reflection surface 2U, of the light radiated from the light emitting chip 4 of the upside semiconductor-type light source 5U.

The vehicle headlamp in the fifth embodiment is made of the constituent elements described above, and if the light emitting chip 4 of the upside semiconductor-type light source 5U is lit to emit light, a part L1 of the light radiated from the upward light emitting face of the light emitting chip 4 of the upside semiconductor-type light source 5U is emitted forward of a vehicle as a light distribution pattern LP for low beam by means of the upside main reflection surface 2U. In addition, light L2 directly radiated forward of the vehicle is shaded by means of the shade 75U without being incident to the upside main reflection surface 2U from the upward light emitting face of the light emitting chip 4 of the upside semiconductor-type light source 5U.

Here, a case in which the shade 75U is not provided at the mount member 70U will be described. In this case, of the light radiated from the upward light emitting face of the light emitting chip 4 of the upside semiconductor-type light source 5U, the light L2 that is not incident to the upside main reflection surface 2U is directly radiated forward of a vehicle and then is emitted forward of the vehicle as a stray light zone LP3 at an upper side of a central part of the light distribution pattern LP for low beam (the zone at a portion surrounded by the dashed line in FIG. 39). The light in the stray light zone LP3 becomes annoying light for a driver of a vehicle in an opposite lane.

On the other hand, according to the vehicle headlamp in the fifth embodiment, the light directly radiated from the upward light emitting face of the light emitting chip 4 of the upside semiconductor-type light source 5U forward of the vehicle without being incident to the upside main reflection surface 2U, i.e., the light L2 that is not controlled to be optically distributed, can be shaded by means of the shade 75U that is provided at the mount member 70U. This makes it possible to reliably prevent the stray light zone LP3 from being emitted to an upper side of a central part of the light distribution pattern LP for low beam.

Further, according to the vehicle headlamp in the fifth embodiment, the optical member of the shade 75U is integrally structured with the mount member 70U, and is mounted on the holder 6 together with the upside semiconductor-type light source 5U via the mount member 70U, so that the light L2 that is not controlled to be optically distributed is reliably shaded by means of the shade 75U as an optical member and can be reliably prevented from being emitted forward of the vehicle.

Other Examples

While the second, fourth and fifth embodiments describe a light distribution pattern LP for low beam, the pattern having cutoff lines CL1, CL2, as a predetermined main light distribution pattern. The second embodiments describe an additional light distribution pattern LP1 having cutoff lines CL1, CL2 as a predetermined additional light distribution pattern. In the foregoing embodiment 4, an additional light distribution pattern LP2 for assistance of middle area diffusion and proximal light was described as a predetermined additional light distribution pattern. The third embodiment describes a light distribution pattern HP for high beam as a predetermined light distribution pattern and an additional light distribution pattern HP1 as a predetermined additional light distribution pattern. However, in the present invention, there may be formed: a predetermined main light distribution pattern and a predetermined additional light distribution pattern other than a light distribution pattern LP1 for low beam, the pattern having cutoff lines CL1, CL2; an additional light distribution pattern LP1 having cutoff lines CL1, CL2; an additional light distribution pattern LP2 for assistance of middle area diffusion and proximal light; and a light distribution pattern HP for high beam and/or additional light distribution pattern HP1. For example, there may be formed a light distribution pattern having an oblique cutoff line on the running lane and a horizontal cutoff line at an opposite lane with an elbow point being a turning point, such as a light distribution pattern for expressway or a light distribution pattern for fog lamp, for example. Alternatively, there may be formed a light distribution pattern which does not have a cutoff line.

The second, third, fourth, and fifth embodiments describe vehicle head lamps 1, 100 for left-side running lane. However, the present embodiment can be applied to a vehicle headlamp for right-side running lane.

What is claimed is:

1. A vehicle headlamp employing a semiconductor-type light source as a light source, said headlamp comprising:

the semiconductor-type light source having a light emitting chip;

a reflector having a reflection surface configured to reflect light from the light emitting chip and to then emit the reflected light forward of a vehicle as a predetermined light distribution pattern;

a holding member configured to hold the reflector and on which the semiconductor-type light source is disposed;

a mount member that mounts the semiconductor-type light source on the holding member, the mount member being arranged above the holding member; and an optical member configured to optically process light directly radiated from the light emitting chip forward of the vehicle, the optical member being configured to shade a part of the light directly radiated, and the optical member being arranged above the mount member, wherein:

the mount member and the optical member form an integrated structure such that the entire optical member is directly arranged above the mount member, the vehicle headlamp further comprises a fixing portion that fixes the mount member forming the integrated structure with the optical member to a surface of the holding member on which the semiconductor-type light source is disposed, the entire optical member is arranged above the holding member, and the semiconductor-type light source is mounted to the holding member via the mount member by fixing the mount member to the holding member with the fixing portion.

2. The vehicle headlamp according to claim 1, wherein the optical member comprises at least a free curved face in which a first reference focal point is at or near the light emitting chip and a second reference focal point is at a location displaced from the light emitting chip, wherein additional reflection surfaces of the optical member are configured to converge and reflect the light directly radiated from the light emitting chip forward of the vehicle on the second reference focal point so as to be emitted as a predetermined additional light distribution pattern forward of the vehicle on an additional reflection surface at the reflector.

3. The vehicle headlamp according to claim 1, wherein the optical member comprises a free curved lens in which a lens focal point is at or near the light emitting chip and the light directly radiated from the light emitting chip forward of the vehicle is emitted forward of the vehicle as a predetermined additional light distribution pattern.

4. The vehicle headlamp according to claim 1, wherein the optical member comprises a shade configured to shade the light directly radiated from the light emitting chip forward of the vehicle.

5. The vehicle headlamp according to claim 1, wherein the optical member projects from a surface of the mount member such that optical member and the mount member comprise the same material.

6. The vehicle headlamp according to claim 1, wherein the optical member includes:

a light shading member that is mounted at center of the mount member; and a plurality of shades that are mounted above each end of the mount member and that are arranged away from the light shading member.

7. The vehicle headlamp according to claim 1, wherein the optical member comprises additional reflection surfaces made of elliptical free curved faces as upside optical members that are symmetrical about a reference optical axis, each of the additional reflection surfaces being disposed on a side of the optical member, and wherein the additional reflection surfaces are provided at a forward side of a central part on a top fixing face of the mount member and are formed integrally with the optical member.

8. The vehicle headlamp according to claim 2, wherein two first shades are integrally structured with the mount member and two second shades are integrally structured with the reflector, and wherein the two first shades and the two second shades are disposed between the additional reflection surfaces of the optical member in proximity to the second reference focal point.

9. The vehicle headlamp according to claim 1, wherein a lamp unit disposed in a lamp room comprises the reflector, the semiconductor-type light source, the holding member, the mount member, and the optical member.

10. The vehicle headlamp according to claim 1, wherein the reflector comprises a window portion formed as a substantially transversely elongated rectangle and provided at an intermediate part of a closed portion of the reflector.

* * * * *